US010782623B2

(12) United States Patent
Yoshiba et al.

(10) Patent No.: US 10,782,623 B2
(45) Date of Patent: Sep. 22, 2020

(54) TONER

(71) Applicant: CANON KABUSHIKI KAISHA, Tokyo (JP)

(72) Inventors: Daisuke Yoshiba, Suntou-gun (JP); Shohei Tsuda, Suntou-gun (JP); Mariko Yamashita, Suntou-gun (JP); Kozue Uratani, Mishima (JP); Ryo Nagata, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/047,413

(22) Filed: Jul. 27, 2018

(65) Prior Publication Data

US 2019/0041762 A1 Feb. 7, 2019

(30) Foreign Application Priority Data

Aug. 4, 2017 (JP) ..... 2017-151621

(51) Int. Cl.

| | |
|---|---|
| ***G03G 9/087*** | (2006.01) |
| ***G03G 9/08*** | (2006.01) |
| ***G03G 9/09*** | (2006.01) |
| ***G03G 9/097*** | (2006.01) |

(52) U.S. Cl.

CPC ..... *G03G 9/08* (2013.01); *G03G 9/0821* (2013.01); *G03G 9/0827* (2013.01); *G03G 9/08711* (2013.01); *G03G 9/08755* (2013.01); *G03G 9/0904* (2013.01); *G03G 9/09716* (2013.01); *G03G 9/09725* (2013.01); *G03G 9/09733* (2013.01)

(58) Field of Classification Search

CPC ..... G03G 9/08755; G03G 9/08782; G03G 9/08797; G03G 9/08708

See application file for complete search history.

(56) References Cited

U.S. PATENT DOCUMENTS

| | | | |
|---|---|---|---|
| 6,613,491 | B2 | 9/2003 | Inoue et al. |
| 7,537,877 | B2 | 5/2009 | Yoshiba et al. |
| 7,544,455 | B2 | 6/2009 | Yoshiba et al. |
| 7,700,254 | B2 | 4/2010 | Moribe et al. |
| 7,740,998 | B2 | 6/2010 | Yamazaki et al. |
| 7,796,926 | B2 | 9/2010 | Matsuda et al. |

(Continued)

FOREIGN PATENT DOCUMENTS

| | | |
|---|---|---|
| JP | H 04-081771 | 3/1992 |
| JP | 2002-214825 | 7/2002 |

(Continued)

*Primary Examiner* — Peter L Vajda

(74) *Attorney, Agent, or Firm* — Venable LLP

(57) ABSTRACT

A toner comprising: a toner particle that contains a binder resin and a colorant: and an external additive, wherein (1) the average circularity of the toner is at least 0.960; (2) the fixing ratio of the external additive on the toner particle is from 75% to 100%; and (3) in a differential curve obtained by the differentiation, by load, of a load-displacement curve where the horizontal axis is load (mN) and the vertical axis is displacement (μm), the load-displacement curve being provided by measurement of the strength of the toner by a nanoindentation procedure, a load A that provides a maximum value in the differential curve in a load region from 0.20 mN to 2.30 mN is from 1.15 mN to 1.50 mN.

9 Claims, 4 Drawing Sheets

(56) References Cited

U.S. PATENT DOCUMENTS

| | | | |
|---|---|---|---|
| 7,855,042 | B2 | 12/2010 | Kobori et al. |
| 8,043,781 | B2 | 10/2011 | Imafuku et al. |
| 8,057,977 | B2 | 11/2011 | Moribe et al. |
| 8,703,378 | B2 | 4/2014 | Satoh et al. |
| 8,918,035 | B2 | 12/2014 | Hasegawa et al. |
| 9,097,998 | B2 | 8/2015 | Yamazaki et al. |
| 9,128,400 | B2 | 9/2015 | Takahashi et al. |
| 9,201,323 | B2 | 12/2015 | Nishikawa et al. |
| 9,244,371 | B2 | 1/2016 | Suzumura et al. |
| 9,250,548 | B2 | 2/2016 | Nomura et al. |
| 9,261,804 | B2 | 2/2016 | Yamazaki et al. |
| 9,304,422 | B2 | 4/2016 | Matsui et al. |
| 9,341,970 | B2 | 5/2016 | Yoshiba et al. |
| 9,348,246 | B2 | 5/2016 | Magome et al. |
| 9,354,545 | B2 | 5/2016 | Matsui et al. |
| 9,377,708 | B2 | 6/2016 | Magome et al. |
| 9,423,712 | B2 | 8/2016 | Sugama et al. |
| 9,442,416 | B2 | 9/2016 | Magome et al. |
| 9,470,993 | B2 | 10/2016 | Nishikawa et al. |
| 9,575,425 | B2 | 2/2017 | Naka et al. |
| 9,588,450 | B2 | 3/2017 | Tsuda et al. |
| 9,606,462 | B2 | 3/2017 | Nomura et al. |
| 9,625,842 | B2 | 4/2017 | Uratani et al. |
| 9,658,546 | B2 | 5/2017 | Tanaka et al. |
| 9,715,188 | B2 | 7/2017 | Terauchi et al. |
| 9,772,570 | B2 | 9/2017 | Tsuda et al. |
| 9,778,583 | B2 | 10/2017 | Terauchi et al. |
| 9,804,514 | B2 | 10/2017 | Suzumura et al. |
| 9,829,818 | B2 | 11/2017 | Yoshiba et al. |
| 9,841,692 | B2 | 12/2017 | Hasegawa et al. |
| 9,857,707 | B2 | 1/2018 | Tsuda et al. |
| 9,904,195 | B2 | 2/2018 | Matsui et al. |
| 9,964,874 | B2 | 5/2018 | Suzumura et al. |
| 9,971,263 | B2 | 5/2018 | Fukudome et al. |
| 10,012,919 | B2 | 7/2018 | Matsui et al. |
| 2011/0151368 | A1 | 6/2011 | Hong et al. |
| 2012/0219892 | A1 | 8/2012 | Ohno et al. |
| 2013/0183617 | A1 | 7/2013 | Eida et al. |
| 2013/0252167 | A1 | 9/2013 | Moribe et al. |
| 2014/0004460 | A1 | 1/2014 | Yoshiba et al. |
| 2015/0086917 | A1* | 3/2015 | Iwasaki ..... G03G 9/09716 430/106.1 |
| 2015/0125790 | A1 | 5/2015 | Hotta et al. |
| 2015/0185658 | A1 | 7/2015 | Wakabayashi et al. |
| 2015/0220013 | A1 | 8/2015 | Nishikawa et al. |
| 2015/0227069 | A1 | 8/2015 | Sugama et al. |
| 2016/0091809 | A1* | 3/2016 | Tsuda ..... G03G 9/083 430/108.7 |
| 2016/0139522 | A1 | 5/2016 | Yoshiba et al. |
| 2016/0161874 | A1 | 6/2016 | Yamazaki et al. |
| 2016/0202624 | A1 | 7/2016 | Nishikawa et al. |
| 2016/0266509 | A1 | 9/2016 | Sano et al. |
| 2016/0378003 | A1 | 12/2016 | Arimura et al. |
| 2017/0160662 | A1 | 6/2017 | Nagashima et al. |
| 2018/0004108 | A1 | 1/2018 | Tsuda et al. |
| 2018/0004109 | A1 | 1/2018 | Matsui et al. |
| 2018/0173125 | A1 | 6/2018 | Fukudome et al. |
| 2018/0173126 | A1 | 6/2018 | Ohmori et al. |
| 2018/0246430 | A1 | 8/2018 | Tanaka et al. |
| 2018/0246432 | A1 | 8/2018 | Nishikawa et al. |
| 2019/0041763 | A1 | 2/2019 | Tsuda et al. |

FOREIGN PATENT DOCUMENTS

| | | |
|---|---|---|
| JP | 2005-270955 | 10/2005 |
| JP | 2005-300937 | 10/2005 |
| JP | 2008-164771 | 7/2008 |
| JP | 2009-036980 | 2/2009 |
| JP | 2009-109661 | 5/2009 |
| JP | 2012-063636 | 3/2012 |
| JP | 2013-109018 | 6/2013 |
| JP | 2015-125271 | 7/2015 |
| JP | 2015-152703 | 8/2015 |
| JP | 2016-038591 | 3/2016 |
| JP | 2016-126220 | 7/2016 |
| JP | 2016-139062 | 8/2016 |
| JP | 2016-139063 | 8/2016 |
| JP | 2016-142758 | 8/2016 |
| JP | 2016-142788 | 8/2016 |
| JP | 2016-142811 | 8/2016 |
| WO | 2013/063291 | 5/2013 |
| WO | 2019/027039 | 2/2019 |

* cited by examiner

TONER

BACKGROUND OF THE INVENTION

Field of the Invention

The present invention relates to a toner used in recording methods such as electrophotography and so forth.

Description of the Related Art

The use of electrophotographic devices such as copiers and printers has spread throughout the world in recent years, and these devices are thus being used in a variety of environments indoors and outdoors. With desktop printers in particular, there has been a change from an environment in which one machine is used by a number of individuals to an environment in which a single machine is used by a single person. As a consequence, there is demand for further reductions in size while at the same time providing a long life and a high image quality.

Reducing the size of the process cartridge, where the developer is stored, is effective for achieving size reductions. The adoption of a cleanerless system is an example of an effective means for downsizing the process cartridge.

Cleaner systems have been adopted in many printers; here, the toner remaining on the electrostatic latent image bearing member (hereafter referred to as untransferred toner) in the transfer step is scraped from the electrostatic latent image bearing member by a cleaning blade and is recovered into a waste toner box. On the other hand, such cleaning blade and waste toner box are not present in a cleanerless system, which can make a substantial contribution to downsizing the body of the machine.

However, a number of properties are also required of the toner in order to adopt a cleanerless system in printers. For example, since the cleaning blade is absent, the untransferred toner, after its passage through the charging step, is recovered to the toner container and is again transported to the developing step. The stress applied to the toner is thus larger than in cleaning blade-equipped systems, and the problems associated with, for example, cracking and breakage of the toner particle, are then prone to occur.

This toner particle cracking and breakage occur to a substantial degree in contact developing systems and under conditions in which members such as the toner carrying member and regulating blade become harder, e.g., low-temperature, low-humidity environments. As a result, the particle size distribution broadens and the generation of satisfactory charging by rubbing between the toner carrying member and blade is impeded and the occurrence of fogging—i.e., a phenomenon in which toner having a low amount of charge is developed into non-image areas on the electrostatic latent image bearing member—is then facilitated. Enhancing the mechanical strength of the toner beyond that currently available is required in order to suppress this fogging phenomenon.

Anticipating the presence of diverse use environments, there have also already been a large number of proposals for enhancing the durability in, for example, low-temperature, low-humidity environments (for example, temperature=15° C./relative humidity=10% RH). However, in view of their easy portability, downsized printers will presumably be used in environments that are even more challenging than heretofore, and, for example, instances of use in lower temperature environments at or below 10° C. have been increasing. Even greater increases in toner strength are thus necessary.

Various proposals have also been made to date for improving toner brittleness.

For example, Japanese Patent Application Laid-open No. 2005-300937 proposes a toner for which the mechanical stability, charging characteristics, transfer characteristics, and fixing characteristics of the toner particle are improved.

In addition, Japanese Patent Application Laid-open No. 2008-164771 proposes a toner that, through control of the elastic modulus of the toner using a Nano Indenter (registered trademark), can provide a stable high-quality image on a long-term basis.

SUMMARY OF THE INVENTION

However, in the case of Japanese Patent Application Laid-open No. 2005-300937, there is still room to improve the mechanical stability in lower temperature environments. While Japanese Patent Application Laid-open No. 2008-164771 does provide excellent effects with regard to, e.g., the fixing performance, image density nonuniformity, and fogging, there is still room for improvement with regard to the mechanical strength of the toner.

An object of the present invention is to provide a toner that can suppress fogging and inhibit the occurrence of toner cracking and breakage in systems where a greater load is applied to the toner, such as cleanerless systems, and that can do so even when used on a long-term basis in a low-temperature environment of 10° C. or below.

The present invention relates to a toner comprising: a toner particle that contains a binder resin and a colorant; and an external additive, wherein (1) the average circularity of the toner is at least 0.960;

(2) the fixing ratio of the external additive on the toner particle is from 75% to 100%; and (3) in a differential curve obtained by the differentiation, by load, of a load-displacement curve where the horizontal axis is load (mN) and the vertical axis is displacement (μm), the load-displacement curve being provided by measurement of the strength of the toner by a nanoindentation procedure, a load A that provides a maximum value in the differential curve in a load region from 0.20 mN to 2.30 mN is from 1.15 mN to 1.50 mN.

The present invention can thus provide a toner that can suppress fogging and inhibit the occurrence of toner particle cracking and breakage in systems where a greater load is applied to the toner, such as cleanerless systems, and that can do so even when used on a long-term basis in a low-temperature environment of 10° C. or below.

Further features of the present invention will become apparent from the following description of exemplary embodiments with reference to the attached drawings.

DESCRIPTION OF THE EMBODIMENTS

Figure 1:
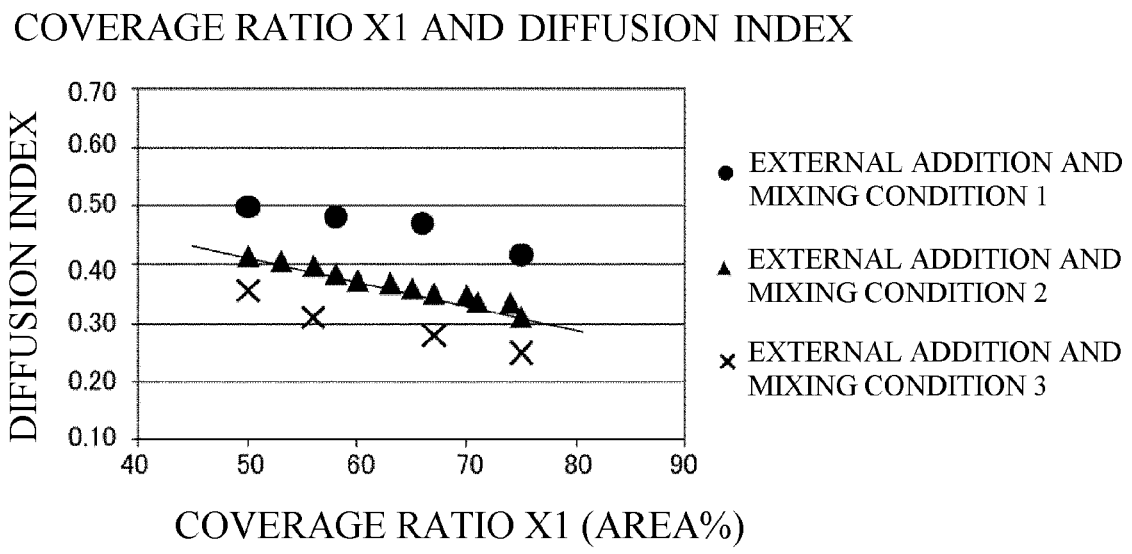
FIG. 1 is a diagram that shows the boundary line for the diffusion index.

Unless specifically indicated otherwise, expressions such as "from XX to YY" and "XX to YY" that show numerical value ranges refer in the present invention to numerical value ranges that include the lower limit and upper limit that are the end points.

As previously indicated, a cleanerless system is effective for achieving the downsizing required of printers in recent years.

In a cleanerless system, the untransferred toner passes through the charging step and is recovered to the toner container and is again transported to the developing step. Due to this, rubbing between the toner and regulating blade occurs a large number of times, creating the potential for toner particle cracking and breakage to occur and for the charge distribution to broaden, and as a result, the fogging easily occurs. Anticipating printer downsizing and a wide variety of use environments, the present inventors carried out intensive investigations mainly for the purpose of improving the fogging caused by toner particle cracking and breakage, particularly in low-temperature environments.

This toner particle cracking and breakage becomes more of a problem as the environmental temperature declines. The reason for this is as follows: the mechanical force applied to the toner is increased due to an increase in the hardness of members such as the charging roller and regulating blade, and in combination with this the appearance of brittleness in the toner itself is also facilitated.

Toner particle cracking and breakage is also affected, on the other hand, by the state of occurrence of the so-called "external additive"—e.g., inorganic fine particles, organic fine particles, or inorganic/organic composite fine particles—present on the toner particle surface. That is, when the toner is subjected to mechanical stress, and when an external additive is present on the toner particle surface, the area of contact is reduced and the mechanical stress can be dispersed. However, the external additive on the toner particle surface can undergo transfer to another cartridge member from the toner particle surface due to long-term use within the cartridge. This results in a reduction in the number of external additive particles on the toner particle surface that are available to disperse mechanical stress, and due to this the occurrence of toner particle cracking and breakage is facilitated.

In order to suppress toner particle cracking and breakage in cleanerless systems, and particularly in low-temperature environments, the present inventors therefore carried out intensive investigations into toner strength and the state of external additive occurrence. They discovered as a result that the aforementioned problems can be solved by adopting the following constitution for a toner containing: a toner particle that contains a binder resin and a colorant; and an external additive. Thus, the toner of the present invention has the following characteristic features:

(1) the average circularity of the toner is at least 0.960;

(2) the fixing ratio of the external additive on the toner particle is from 75% to 100%; and (3) in a differential curve obtained by the differentiation, by load, of a load-displacement curve where the horizontal axis is load (mN) and the vertical axis is displacement (μm), the load-displacement curve being provided by measurement of the strength of the toner by a nanoindentation procedure, a load A that provides a maximum value in the differential curve in a load region from 0.20 mN to 2.30 mN is from 1.15 mN to 1.50 mN.

The present inventors first carried out investigations with regard to toner strength that could be maintained even in a low-temperature environment. Nanoindentation was adopted as the index of toner strength for the present invention. A nanoindentation procedure is an evaluation method in which a diamond indenter is pressed into the sample mounted on a stage; the load (pressing force) and displacement (depth of insertion) are measured; and the mechanical properties are analyzed using the resulting load-displacement curve.

Microcompression testers have been used to evaluate the mechanical properties of toners, but they are suitable for evaluating the macromechanical properties of toners because the indenter used in microcompression testers is larger than the size of a toner particle.

However, property evaluation in a smaller region is required because the toner particle cracking and breakage that are the focus of the present invention—and particularly the cracking—are affected by the micromechanical properties of the toner particle surface. In measurements using a nanoindentation procedure, the indenter has a triangular pyramidal shape and the tip of the indenter is substantially smaller than the size of a toner particle. As a consequence, a nanoindentation procedure is suitable for evaluating the micromechanical properties of the toner particle surface.

As a result of intensive investigations, the present inventors discovered that, with regard to the mechanical properties of toner, control into a special range in measurement by nanoindentation is crucial.

Thus, in the differential curve obtained by the differentiation, by load, of a load-displacement curve where the horizontal axis is load (mN) and the vertical axis is displacement (μm), the load-displacement curve being provided by measurement of the strength of the toner by a nanoindentation procedure, a characteristic feature of the present invention is that the load A that provides the maximum value in the differential curve in the load region from 0.20 mN to 2.30 mN is from 1.15 mN to 1.50 mN.

In a nanoindentation measurement, the displacement is measured while pressing the indenter into the sample by the continuous application of a very small load to the toner, and a load-displacement curve is then constructed placing the load (mN) on the horizontal axis and the displacement (μm) on the vertical axis.

At the load in the load-displacement curve where the displacement from the load reaches a maximum, the toner particle undergoes a large deformation, i.e., it is thought that a phenomenon corresponding to cracking is produced. The load that provides the largest slope in this load-displacement curve was therefore used in the present invention as the load at which toner particle cracking is produced. That is, a larger load at which the largest slope occurs indicates that the load required for toner particle cracking is also larger and that toner particle cracking is thus made more difficult.

The procedure in the present invention for determining the load that provides the largest slope was to use the load at which the value of the derivative assumed a maximum value in the differential curve provided by differentiating the load-displacement curve by load.

In specific terms, a characteristic feature is that in the differential curve obtained by the differentiation, by load, of the load-displacement curve, the load A that provides the maximum value in the differential curve in the load region from 0.20 mN to 2.30 mN is from 1.15 mN to 1.50 mN. From 1.20 mN to 1.50 mN is preferred, while from 1.25 mN to 1.50 mN is more preferred.

Controlling the load A into the indicated range provides a certain effect in terms of inhibiting toner particle cracking and breakage in cleanerless systems and particularly in low-temperature environments.

A higher value for the load A indicates a higher toner strength and an easier inhibition of toner particle cracking;

however, when the load A is higher than 1.50 mN, control of the attachability of the external additive is impaired, described below, and the fixing performance is also reduced. The load A must therefore be not more than 1.50 mN. The reason for using a load range of from 0.20 mN to 2.30 mN in the determination of the differential curve is to minimize sample-to-sample variations and variations caused by the measurement conditions. The load A can be controlled by controlling the molecular weight of the toner and by controlling the heating conditions in the toner production process described below.

In addition, measurement of the toner by a nanoindentation procedure is strongly affected by the shape of the toner. The average circularity of the toner is thus crucial, and it was discovered that the evaluation could be carried out with good reproducibility when the average circularity was at least 0.960. Accordingly, an average circularity for the toner of at least 0.960 is stipulated in the present invention as a prerequisite. At least 0.970 is preferable and, while there are no particular limitations on the upper limit, it is preferably not more than 1.000.

In order to raise the toner strength, investigations were also carried out for the present invention focusing on the state of occurrence of the external additive on the toner particle surface.

As noted above, in order for the external additive on the toner particle surface to inhibit toner particle cracking, it is critical to maintain the number of external additive particles that can exhibit a mechanical stress-dispersing effect on the toner particle surface. Increasing the fixing ratio for the external additive is required for this. A fixing ratio for the external additive on the toner particle of from 75% to 100% is required, while from 80% to 100% is preferred.

However, there are high technical hurdles to having a high fixing ratio for the external additive coexist with maintenance of the toner mechanical strength, and achieving this has been highly problematic to date.

Thus, when an increase in the external additive fixing ratio is sought, the external additive must then be impinged into the toner particle surface with greater force. When toner is produced under such conditions, the toner is subjected to a mechanical load and as a consequence residual stress (strain) readily accumulates in the interior. When the toner is subjected to mechanical shear in the cartridge, toner particle cracking, which originates from the residual stress accumulated in the interior of the toner, is readily promoted.

On the other hand, when, in order to raise the mechanical strength of toner, impingement of the external additive is carried out using a weak force so as to avoid the generation of strain, the toner strength can be maintained, but achieving a high fixing ratio is then problematic. In addition, when using the approach of raising the molecular weight of the toner (for example, the peak molecular weight of the THF-soluble matter), which is effective for raising the mechanical strength of toner, immobilization of the external additive is similarly difficult to bring about, while a reduction in the fixing performance is also facilitated.

As a consequence, the concept itself of seeking to have the maintenance of toner strength coexist with a strong immobilization of the external additive has been almost unseen in toner design up to now.

A characteristic feature of the present invention is that maintenance of toner strength is made to coexist with a high fixing ratio for the external additive, which has not been a conventional concept. This made it possible to achieve a high level of inhibition of toner particle cracking and breakage, and thus made it possible to obtain clear, crisp images free of fogging in systems in which higher loads are applied to toner, such as cleanerless systems, as well as in very low-temperature environments.

A preferred method for producing the toner according to the present invention is described in the following.

In order to have an improved mechanical strength for the toner coexist with a strong state of immobilization for the external additive, a heating step is preferably provided in or after the external addition step in which the external additive is attached to the toner particle surface.

While, for example, increasing the molecular weight of the toner is effective for increasing the mechanical strength, the fixing performance may also be reduced when the molecular weight is increased too much.

The disposition of a heating step in or after the external addition step is preferred in order to improve the mechanical strength of the toner without excessively increasing the molecular weight. By doing this, immobilization of the external additive can be enhanced by the heating while at the same time the residual stress produced in the toner in the external addition step is relaxed.

Bringing about stabilization by eliminating the molecular chain strain in the toner that is produced by the external addition step was found to be effective for relaxing this residual stress. An effective means for eliminating this molecular chain strain is a step of heating at around the glass transition temperature Tg of the toner particle, where the molecular chains undergo motion, the heating step being performed during or after the external addition step. Moreover, by heating at around Tg, the toner particle undergoes a slight thermal deformation and attachment of the external additive to the toner particle is also more efficiently developed, and this is thus preferred.

Using Tg for the glass transition temperature of the toner particle, the condition $Tg-10° C. \leq T_R \leq Tg+5° C.$ is preferred for the temperature $T_R$ in the heating step, while $Tg-5° C. \leq T_R \leq Tg+5° C.$ is more preferred. The heating time is not particularly limited, but is preferably from 3 minutes to 30 minutes and is more preferably from 3 minutes to 10 minutes.

Viewed from the standpoint of the storability, the glass transition temperature Tg of the toner particle is preferably from 40° C. to 70° C. and is more preferably from 50° C. to 65° C.

An apparatus having a mixing functionality is preferred for the apparatus used in the heating step. A known mixing process apparatus may be used, but an apparatus as shown in FIG. 2 is preferred from the standpoints of the efficiency of stress relaxation and the efficiency of immobilization of the external additive.

Figure 2:
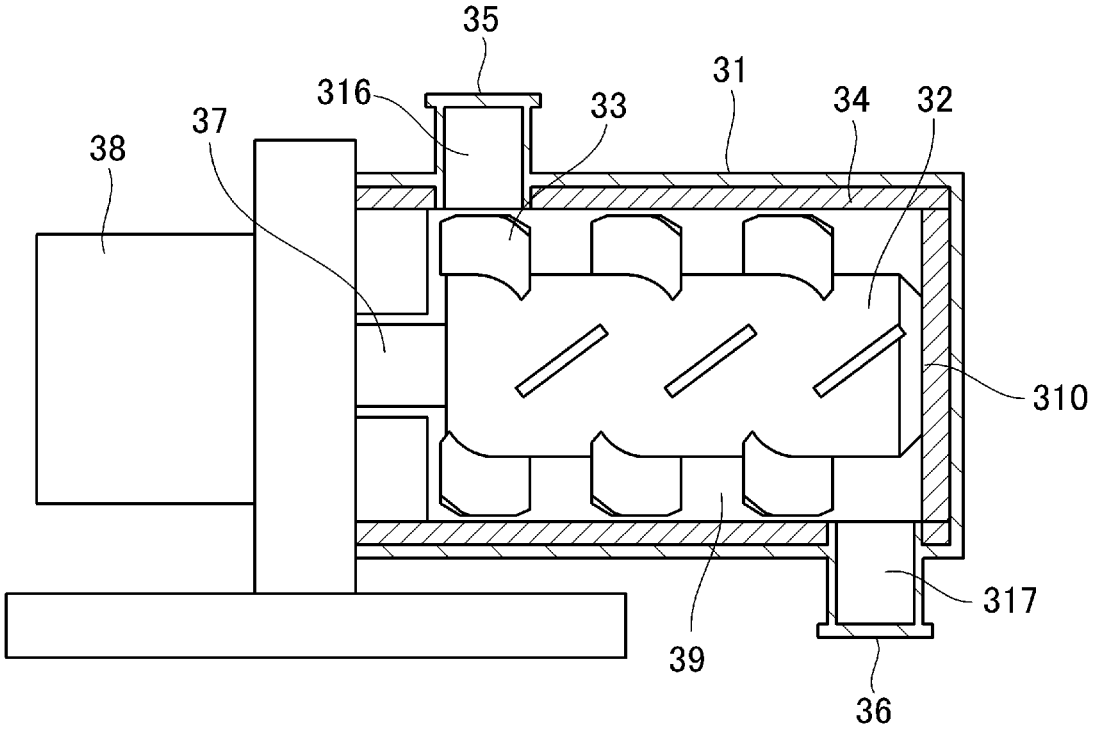
FIG. 2 is a schematic diagram that shows an example of a mixing process apparatus used for the external addition of inorganic fine particles.

FIG. 2 is a schematic diagram that shows an example of a mixing process apparatus that can be used in the heating step.

Figure 3:
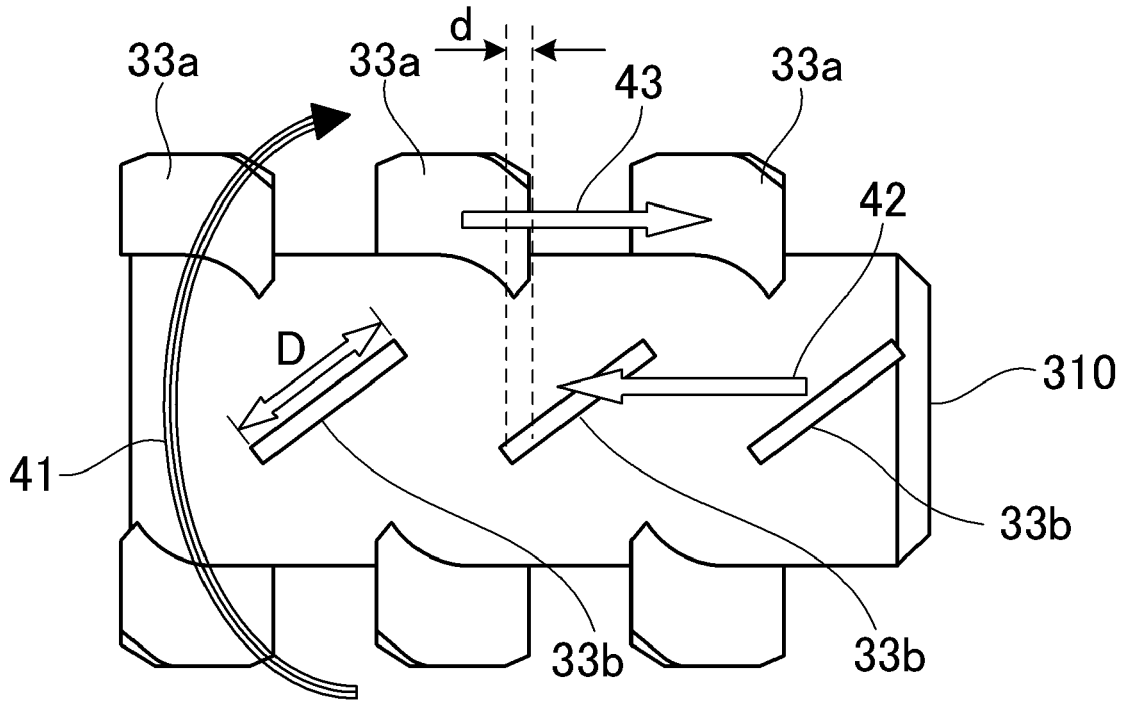
FIG. 3 is a schematic diagram that shows an example of the structure of the stirring member used in the mixing process apparatus.

FIG. 3, on the other hand, is a schematic diagram that shows an example of the structure of the stirring member used in the aforementioned mixing process apparatus. This mixing process apparatus has a rotating member 32, on the surface of which at least a plurality of stirring members 33 are disposed; a drive member 38, which drives the rotation of the rotating member; and a main casing 31, which is disposed to have a gap with the stirring members 33.

At the gap (clearance) between the inner circumference of the main casing 31 and the stirring member 33, heat is efficiently applied to the toner, in combination therewith a uniform shear is imparted to the toner, and the external additive is attached to the toner particle surface while being broken up from secondary particles into primary particles.

Moreover, as described below, circulation of the toner particles and external additive in the axial direction of the stirring member is facilitated and, because a uniform and thorough mixing is facilitated prior to the progress of attachment, control of the coverage ratio X1 and diffusion index, infra, into the ranges preferred for the present invention is facilitated.

The diameter of the inner circumference of the main casing 31 in this apparatus is not more than twice the diameter of the outer circumference of the rotating member 32. An example is shown in FIG. 2 in which the diameter of the inner circumference of the main casing 31 is 1.7-times the diameter of the outer circumference of the rotating member 32 (the trunk diameter provided by excluding the stirring members 33 from the rotating member 32). When the diameter of the inner circumference of the main casing 31 is not more than twice the diameter of the outer circumference of the rotating member 32, the external additive taking the form of secondary particles is thoroughly dispersed since the processing space in which forces act on the toner particle is suitably limited.

In addition, it is important to adjust the aforementioned clearance in conformity to the size of the main casing. It is important from the standpoint of efficiently applying heat to the toner that the clearance is approximately from 1% to 5% of the diameter of the inner circumference of the main casing 31. Specifically, when the diameter of the inner circumference of the main casing 31 is approximately 130 mm, the clearance is preferably made approximately from 2 mm to 5 mm; when the diameter of the inner circumference of the main casing 31 is about 800 mm, the clearance is preferably made approximately from 10 mm to 30 mm.

As shown in FIG. 3, at least a portion of the plurality of stirring members 33 is formed as a forward transport stirring member 33*a* that, accompanying the rotation of the rotating member 32, transports the toner in one direction along the axial direction of the rotating member. In addition, at least a portion of the plurality of stirring members 33 is formed as a back transport stirring member 33*b* that, accompanying the rotation of the rotating member 32, returns the toner in the other direction along the axial direction of the rotating member. Here, when a starting material inlet port 35 and a product discharge port 36 are disposed at the two ends of the main casing 31, as in FIG. 2, the direction toward the product discharge port 36 from the starting material inlet port 35 (the direction to the right in FIG. 2) is the "forward direction".

That is, as shown in FIG. 3, the face of the forward transport stirring member 33*a* is tilted so as to transport the toner in the forward direction 43. On the other hand, the face of the back transport stirring member 33*b* is tilted so as to transport the toner in the back direction 42.

By means of the preceding, a heating process is carried out while repeatedly performing transport in the "forward direction" 43 and transport in the "back direction" 42. In addition, with regard to the stirring members 33*a* and 33*b*, a plurality of members disposed at intervals in the circumferential direction of the rotating member 32 form a set. In the example shown in FIG. 3, two members at an interval of 180° with each other form a set of the stirring members 33*a* and 33*b* on the rotating member 32, but a larger number of members may form a set, such as three at an interval of 120° or four at an interval of 90°.

In the example shown in FIG. 3, a total of twelve stirring members 33*a* and 33*b* are formed at an equal interval.

Furthermore, D in FIG. 3 indicates the width of a stirring member and d indicates the distance that represents the overlapping portion of a stirring member. In FIG. 3, D is preferably a width that is approximately from 20% to 30% of the length of the rotating member 32, when considered from the standpoint of bringing about an efficient transport of the toner in the forward direction and back direction. FIG. 3 shows an example in which D is 23%. Moreover, when an extension line is drawn in the perpendicular direction from the position of the end of the stirring member 33*a*, the stirring members 33*a* and 33*b* preferably have a certain overlapping portion d of the stirring member 33*a* with the stirring member 33*b*.

This makes it possible to efficiently disperse the external additive on the toner particle surface. This d is preferably from 10% to 30% of D from the standpoint of the application of shear.

In addition to the shape shown in FIG. 3, the blade shape may be—insofar as the toner particles can be transported in the forward direction and back direction and the clearance is maintained—a shape having a curved surface or a paddle structure in which a distal blade element is connected to the rotating member 32 by a rod-shaped arm.

A more detailed explanation follows with reference to the schematic diagrams of the apparatus shown in FIGS. 2 and 3.

The apparatus shown in FIG. 2 has a rotating member 32, which has at least a plurality of stirring members 33 disposed on its surface; a drive member 38 that drives the rotation of the rotating member 32; and a main casing 31, which is disposed forming a gap with the stirring members 33. It also has a jacket 34, in which a heat transfer medium can flow and which resides on the inside of the main casing 31 and adjacent to the end surface 310 of the rotating member.

In addition, the apparatus shown in FIG. 2 has a starting material inlet port 35, which is formed on the upper side of the main casing 31, and has a product discharge port 36, which is formed on the lower side of the main casing 31. The starting material inlet port 35 is used to introduce the toner, and the product discharge port 36 is used to discharge, from the main casing 31 to the outside, the toner that has been subjected to the external addition and mixing process.

The apparatus shown in FIG. 2 also has a starting material inlet port inner piece 316 inserted in the starting material inlet port 35 and a product discharge port inner piece 317 inserted in the product discharge port 36.

The starting material inlet port inner piece 316 is first removed from the starting material inlet port 35; the toner is introduced into the processing space 39 from the starting material inlet port 35; and the starting material inlet port inner piece 316 is inserted. The rotating member 32 is subsequently rotated by the drive member 38 (41 indicates the direction of rotation), and the material to be processed, introduced as described above, is subjected to a heating and mixing process while being stirred and mixed by the plurality of stirring members 33 disposed on the surface of the rotating member 32.

Heating can be performed by passing hot water at the desired temperature into the jacket 34. The temperature is monitored by a thermocouple disposed in the interior of the starting material inlet port inner piece 316. In order to obtain the toner according to the present invention on a stable basis, the temperature $T_R$ (thermocouple temperature) in the interior of the starting material inlet port inner piece 316 preferably satisfies the condition $Tg-10°\ C. \leq T_R \leq Tg+5°\ C.$ where Tg is the glass transition temperature of the toner particle, while $Tg-5°\ C. \leq T_R \leq Tg+5°\ C.$ is more preferred.

With regard to the conditions for the heating and mixing process, the power of the drive member 38 is controlled preferably to from $1.0\times10^{-3}$ W/g to $1.0\times10^{-1}$ W/g and more preferably from $5.0\times10^{-3}$ W/g to $5.0\times10^{-2}$ W/g. In order to relax the internal stress in the toner and increase the mechanical strength of the toner, external energy is preferably not imparted to the toner to the greatest extent possible. On the other hand, in order to provide a uniform state of attachment and state of coverage for the external additive, a minimum power is required, and control into the range indicated above is preferred.

The power of the drive member 38 is the value obtained by subtracting the empty power (W) during operation when the toner has not been introduced, from the power (W) when the toner has been introduced, and dividing by the amount (g) of toner introduced.

The processing time is not particularly limited since it also depends on the heating temperature, but is preferably from 3 minutes to 30 minutes and is more preferably from 3 minutes to 10 minutes. Control into this range facilitates the coexistence of the toner strength with immobilization.

The rotation rate of the stirring members is linked to the aforementioned power and operation and is thus not particularly limited. For the apparatus shown in FIG. 2 in which the volume of the processing space 39 of the apparatus is $2.0\times10^{-3}$ $m^3$, the rpm of the stirring members—when the shape of the stirring members 33 is as shown in FIG. 3—is preferably from 50 rpm to 500 rpm and is more preferably from 100 rpm to 300 rpm.

After the completion of the mixing process, the product discharge port inner piece 317 in the product discharge port 36 is removed and the toner is discharged from the product discharge port 36 by rotating the rotating member 32 with the drive member 38. As necessary, for example, coarse toner particles may be separated by sieving using, e.g., a circular vibrating sieve.

The heating step is preferably provided in toner production during or after the external addition step. Using the mixing process conditions described in the preceding, external addition and the heating process may be carried out at the same time, or the heating process may be performed using the aforementioned apparatus on toner for which the external addition step has been completed.

Heating is more preferably carried out using the aforementioned mixing process apparatus after performing mixing and external addition of the toner particle and external additive using a known mixer such as a Henschel mixer.

The following are examples of the mixer: Henschel mixer (Nippon Coke & Engineering Co., Ltd.); Supermixer (Kawata Mfg. Co., Ltd.); Ribocone (Okawara Mfg. Co., Ltd.); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The toner according to the present invention has the aforementioned characteristics, but is not otherwise limited; however, a constitution as given by the following is more preferred.

The coverage ratio X1 of the toner particle surface by the external additive, as measured using an x-ray photoelectron spectrometer (ESCA), is preferably from 40.0 area % to 80.0 area % and is more preferably from 45.0 area % to 60.0 area %.

By controlling this coverage ratio of the toner according to the present invention—which has the external additive firmly attached to the toner particle surface—into the indicated range, a suitable charge distribution can be maintained and the so-called development ghosts produced during development can be brought to better levels.

In addition, the diffusion index represented by the following formula (1) preferably satisfies the following formula (2) where X2 is the theoretical coverage ratio of the toner particle surface by the external additive.

$$\text{Diffusion index}=X1/X2 \quad (1)$$

$$\text{Diffusion index}\geq-0.0042\times X1+0.62 \quad (2)$$

This coverage ratio X1 is determined as follows.

(i) The external additive by itself is measured by ESCA to determine the detected intensity Xa of a specific atom constituting the external additive.

(ii) ESCA measurement is then carried out on a toner sample to determine the detected intensity Xb for an atom originating with the external additive (the same atom as in (i)).

The coverage ratio X1 is determined from the ratio between this Xb and Xa (Xb/Xa).

For example, when silica fine particles are used as the external additive, the determination can be made from the ratio of the detected intensity for the Si atom when the toner is measured by ESCA to the detected intensity for the Si atom when the silica fine particle is measured by itself.

When a plurality of species are used for the external additive, the coverage ratio X1 is determined for each of the external additives and these are then summed to give the value used for X1.

This coverage ratio X1 represents the percentage of the toner particle surface taken up by the area that is actually covered by the external additive.

The theoretical coverage ratio X2 for the external additive, on the other hand, is determined using the following formula (3) and, e.g., the particle diameter of the external additive, the number of mass parts of the external additive per 100 mass parts of the toner particle, and so forth. This represents the area that can be theoretically covered as a percentage of the toner particle surface.

$$\text{Theoretical coverage ratio X2(area \%)}=3^{1/2}/(2\pi)\times(dt/da)\times(\rho t/\rho a)\times C\times100 \quad (3)$$

When a plurality of species are used for the external additive, the theoretical coverage ratio X2 is determined for each external additive and these are summed to give the value used for X2.

da: number-average particle diameter (D1) of the external additive dt: weight-average particle diameter (D4) of the toner ρa: true density of the external additive ρt: true density of the toner C: mass of the external additive/mass of the toner (=number of parts of addition (mass parts) of the external additive per 100 mass parts of the toner particle/(number of parts of addition (mass parts) of the external additive per 100 mass parts of the toner particle+100 (mass parts)))

(When the amount of addition of the external additive is unclear, the amount of addition of the external additive is determined based on the measurement procedure in "Content of the External Additive in the Toner" described below, and this is used for "C". In addition, the number-average particle diameter (D1) of the external additive is the value obtained based on measurement of the number-average particle diameter (D1) of the primary particles of the external additive based on observation of the toner particle surface as described below. However, when it is difficult to carry out the determination by observation of the surface, for example, when a plural number of external additive species are used, the number-average particle diameter of each external additive as measured in advance may be used.)

The physical meaning of the diffusion index represented by formula (1) is described in the following.

The diffusion index indicates the divergence between the actually measured coverage ratio X1 and the theoretical coverage ratio X2. It is thought that the magnitude of this divergence indicates the degree to which the external additive has become stacked up into two or three layers in the vertical direction from the toner particle surface. The diffusion index is ideally 1, in which case the coverage ratio X1 agrees with the theoretical coverage ratio X2 and a condition is assumed in which external additive stacked in two or more layers is completely absent.

When, on the other hand, the external additive is present on the toner surface as an aggregate, the theoretical coverage ratio diverges from the actually measured coverage ratio and the diffusion index then declines. The diffusion index can thus also be regarded as indicating the amount of external additive that is present as an aggregate.

The diffusion index is preferably in the range indicated by formula (2). This indicates, in other words, that the dispersion index preferably takes on at least a certain value.

A large diffusion index indicates that, of the external additive on the toner particle surface, little is present as aggregate while a large amount is present as the primary particle. When the external additive is present as the primary particle, the external additive can then attach to the toner particle surface in a more uniform state. Due to this, an excellent image density can be obtained while a high developing efficiency can be maintained and fogging can be suppressed.

The boundary line for the diffusion index is a function in which the coverage ratio X1 is used as the variable in the coverage ratio X1 range of from 40.0 area % to 80.0 area %.

This function was determined as follows: at each of three different external addition/mixing conditions, the amount of external agent addition was varied to produce toners having freely varied coverage ratios X1, and a graph (FIG. 1) was constructed by plotting the relationship between the coverage ratio X1 and the diffusion index. As a result of evaluations of the image density after durability testing on the toners plotted in this graph, it was found that a satisfactory image density was obtained for the toners that plotted in the range that satisfied formula (2).

Here, the present inventors hypothesize the following with regard to the reason that the diffusion index is dependent on the coverage ratio X1. In order to achieve a high developing efficiency, it is desirable for the amount of external additive present as secondary particles to be small, but the effect of the coverage ratio X1 is also not inconsiderable. The developing efficiency gradually improves as the coverage ratio X1 increases, and due to this the allowable amount of the external additive present as secondary particles increases. It is thus thought that the boundary line for the diffusion index will be a function with the coverage ratio X1 as the variable.

That is, there is a correlation between the coverage ratio X1 and the diffusion index, and the diffusion index is preferably controlled in correspondence to the coverage ratio X1.

In addition, the Total Energy is preferably from 200 mJ to 400 mJ and more preferably from 250 mJ to 350 mJ when, using a powder flowability measuring apparatus, the surface of a toner powder layer produced in the measurement vessel by application of a vertical load of 0.88 kPa is penetrated by a propeller-type blade while rotating the propeller-type blade at a peripheral velocity, at the outermost edge thereof, of 10 mm/second.

This powder flowability measuring apparatus is an apparatus that can insert a rotating propeller-type blade into a consolidated powder layer and that can determine the shear applied at this time as the Total Energy (mJ). For example, it is suitable for representing the flow condition of toner subjected to shear within the cartridge. When the attachment strength of the external additive to the toner particle is increased, a trend is assumed in which a reduction in toner flowability is facilitated. That is, a trend of an increasing Total Energy is assumed. By carrying out the heating step, an increase in the fixing ratio of the external additive is made possible in the present invention without causing an increase in the Total Energy.

Moreover, even when the Total Energy is excessively low, it is necessary to strike a balance with the transportability within the cartridge. By controlling the Total Energy to from 200 mJ to 400 mJ, a toner can be provided that is resistant, even in the latter half of a durability test, to the appearance of the fading in which band-like drop out is produced in the image.

The Total Energy can be controlled using the conditions in the external addition step and the heating step.

There are no particular limitations on the external additive as long as its fixing ratio on the toner particle is from 75% to 100%. The external additive preferably contains external additive having a number-average particle diameter (D1) preferably from 40 nm to 200 nm and more preferably from 80 nm to 150 nm.

By using external additive having a particle diameter in the indicated range and achieving the previously described strong state of attachment, even in high-temperature, high-humidity environments a stable image density can be obtained on a long-term basis without producing an excessive burying or embedding of the external additive.

In addition, the external additive having a number-average particle diameter (D1) of from 40 nm to 200 nm is more preferably used in combination with another, separate external additive having a smaller particle diameter. Control of the charging performance and flowability is facilitated by the use of external additives having different particle diameters, i.e., a larger particle diameter and a smaller particle diameter.

When a combination of external additives is used, the use is preferred of an external additive A having a number-average particle diameter from 40 nm to 200 nm and an external additive B having a number-average particle diameter (D1) from 5 nm to less than 40 nm.

The external additive content, per 100 mass parts of the toner particle, is preferably from 0.3 mass parts to 3.5 mass parts and is more preferably from 0.5 mass parts to 2.5 mass parts.

The content of the external additive A, per 100 mass parts of the toner particle, is preferably from 0.5 mass parts to 2.5 mass parts.

The content of the external additive B, per 100 mass parts of the toner particle, is preferably from 0.3 mass parts to 1.0 mass part.

There are no particular limitations on the external additive used in the present invention, and, for example, inorganic fine particles, organic fine particles, and organic/inorganic composite fine particles constituted of an inorganic material and an organic material may be used.

The inorganic fine particles can be exemplified by fine particles such as silica fine particles, alumina fine particles, titania fine particles, and composite oxide fine particles of the preceding. Silica fine particles are preferred among the preceding.

The method for producing the silica fine particles can be exemplified by the following: combustion methods, which yield silica fine particles by the combustion of a silane compound (i.e., methods for producing fumed silica); deflagration methods, which yield silica fine particles by the explosive combustion of a silicon metal powder; wet methods, which yield silica fine particles by a neutralization reaction between a mineral acid and sodium silicate; and sol-gel methods, which yield silica fine particles by the hydrolysis of alkoxysilane, e.g., hydrocarbyloxysilane (known as the Stoeber method).

The inorganic fine particles used preferably have a hydrophobicity that has been controlled using a hydrophobic treatment. Controlling the hydrophobicity facilitates segregation of the inorganic fine particles to the droplet/hydrophobic dispersion medium interface and facilitates an improved dispersion stability by the droplet. There is no particular limitation on the method for carrying out a hydrophobic treatment on the inorganic fine particles, and, while a known method can be used, methods in which the inorganic fine particles are treated with a hydrophobic treatment agent are preferred.

The hydrophobic treatment agent can be exemplified by the following: chlorosilanes such as methyltrichlorosilane, dimethyldichlorosilane, trimethylchlorosilane, phenyltrichlorosilane, diphenyldichlorosilane, t-butyldimethylchlorosilane, and vinyltrichlorosilane;

alkoxysilanes such as tetramethoxysilane, methyltrimethoxysilane, dimethyldimethoxysilane, phenyltrimethoxysilane, diphenyldimethoxysilane, o-methylphenyltrimethoxysilane, p-methylphenyltrimethoxysilane, n-butyltrimethoxysilane, i-butyltrimethoxysilane, hexyltrimethoxysilane, octyltrimethoxysilane, decyltrimethoxysilane, dodecyltrimethoxysilane, tetraethoxysilane, methyltriethoxysilane, dimethyldiethoxysilane, phenyltriethoxysilane, diphenyldiethoxysilane, i-butyltriethoxysilane, decyltriethoxysilane, vinyltriethoxysilane, γ-methacryloxypropyltrimethoxysilane, γ-glycidoxypropyltrimethoxysilane, γ-glycidoxypropylmethyldimethoxysilane, γ-mercaptopropyltrimethoxysilane, γ-chloropropyltrimethoxysilane, γ-aminopropyltrimethoxysilane, γ-aminopropyltriethoxysilane, γ-(2-aminoethyl)aminopropyltrimethoxysilane, and γ-(2-aminoethyl) aminopropylmethyldimethoxysilane;

silazanes such as hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane, and dimethyltetravinyldisilazane;

silicone oils such as dimethylsilicone oil, methylhydrogensilicone oil, methylphenylsilicone oil, alkyl-modified silicone oil, chloroalkyl-modified silicone oil, chlorophenyl-modified silicone oil, fatty acid-modified silicone oil, polyether-modified silicone oil, alkoxy-modified silicone oil, carbinol-modified silicone oil, amino-modified silicone oil, fluorine-modified silicone oil, and silicone oil having terminal reactivity;

siloxanes such as hexamethylcyclotrisiloxane, octamethylcyclotetrasiloxane, decamethylcyclopentasiloxane, hexamethyldisiloxane, and octamethyltrisiloxane; and fatty acids and their metal salts, such as long-chain fatty acids, e.g., undecylic acid, lauric acid, tridecylic acid, dodecylic acid, myristic acid, palmitic acid, pentadecylic acid, stearic acid, heptadecylic acid, arachidic acid, montanic acid, oleic acid, linoleic acid, and arachidonic acid, as well as the salts of these fatty acids with metals such as zinc, iron, magnesium, aluminum, calcium, sodium, and lithium.

Among the preceding, the alkoxysilanes, silazanes, and silicone oils support a facile execution of the hydrophobic treatment and are thus preferred. A single one of these hydrophobic treatment agents may be used by itself or two or more may be used in combination.

The organic fine particles can be exemplified by resin particles of, e.g., a vinyl resin, polyester resin, or silicone resin.

The composite fine particles of an inorganic material and an organic material can be exemplified by organic/inorganic composite fine particles constituted of an inorganic material and an organic material.

In the case of an organic/inorganic composite fine particle, the excellent durability and charging performance of inorganic materials is maintained while the inhibition during fixing of toner particle-to-toner particle unification is suppressed due to the organic material component, which has a low heat capacity, and the appearance of fixing inhibition is then suppressed. This serves to facilitate a design in which durability coexists with fixing performance.

A preferred constitution for the organic/inorganic composite fine particle is a composite fine particle having a structure in which inorganic fine particles are embedded in the surface of a resin fine particle (preferably a vinyl resin fine particle) that is the organic component. In a more preferred structure, the inorganic fine particles are exposed at the surface of the vinyl resin particle. An even more preferred structure has protruded portions, caused by the inorganic fine particles, at the surface of the vinyl resin particle. The external additive preferably contains at least one selected from the group consisting of silica fine particles and organic/inorganic composite fine particles.

For example, lubricants, e.g., fluororesin powder, zinc stearate powder, and polyvinylidene fluoride powder, and abrasives, e.g., cerium oxide powder, silicon carbide powder, and strontium titanate powder, may be used as external additives other than the preceding.

In addition, when the wettability of the toner relative to a methanol/water mixed solvent is measured using the transmittance of light having a wavelength of 780 nm, the methanol concentration at a transmittance of 40% is preferably from 40 volume % to 62 volume % and more preferably from 50 volume % to 60 volume %.

The methanol wettability represents the hydrophobicity of the toner, and, by controlling the methanol wettability into the indicated range, insufficient charging in high-humidity environments and overcharging in low-humidity environments can be suppressed and the coating defects on the developing sleeve that accompany defective charging can then be suppressed.

The methanol wettability can be controlled using the temperature and time in the external addition step and, for example, when a release agent is used, by varying the state of occurrence of the release agent in the toner.

It can also be controlled using the temperature conditions in the heating step disposed in or after the external addition step.

Preferred embodiments of the present invention are described in greater detail in the following.

The binder resin used in the toner can be exemplified by the following: vinyl resins, styrene resins, styrene copolymer resins, polyester resins, polyol resins, polyvinyl chloride resins, phenolic resins, natural resin-modified phenolic resins, natural resin-modified maleic acid resins, acrylic resins, methacrylic resins, polyvinyl acetate, silicone resins, polyurethane resins, polyamide resins, furan resins, epoxy resins, xylene resins, polyvinyl butyral, terpene resins, coumarone-indene resins, and petroleum resins.

The following are preferred: styrene copolymer resins, polyester resins, and hybrid resins provided by mixing a polyester resin with a vinyl resin or by partially reacting the two.

The toner may contain a release agent.

The release agent can be exemplified by waxes in which the major component is fatty acid ester, such as carnauba wax and montanic acid ester wax; waxes provided by the partial or complete deacidification of the acid component from fatty acid esters, such as deacidified carnauba wax; hydroxyl group-containing methyl ester compounds obtained by, for example, the hydrogenation of plant oils; the monoesters of saturated fatty acids, e.g., stearyl stearate and behenyl behenate; diesters between a saturated aliphatic dicarboxylic acid and a saturated aliphatic alcohol, e.g., dibehenyl sebacate, distearyl dodecanedioic acid, and distearyl octadecanedioic acid; diesters between a saturated aliphatic diol and a saturated fatty acid, e.g., nonanediol dibehenate and dodecanediol distearate; aliphatic hydrocarbon waxes, e.g., low molecular weight polyethylene, low molecular weight polypropylene, microcrystalline wax, paraffin wax, and Fischer-Tropsch wax; oxides of aliphatic hydrocarbon waxes, such as oxidized polyethylene wax, and their block copolymers; waxes provided by grafting an aliphatic hydrocarbon wax using a vinylic monomer such as styrene or acrylic acid; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; and long-chain alkyl alcohols having at least 12 carbons and long-chain alkyl carboxylic acids having at least 12 carbons.

The following are preferred from among these release agents: monofunctional ester waxes such as saturated fatty acid monoesters, difunctional ester waxes such as saturated fatty acid diesters, and hydrocarbon waxes such as paraffin wax and Fischer-Tropsch waxes.

In addition, 60° C. to 140° C. is preferred for the melting point as given by the peak temperature of the maximum endothermic peak during ramp up in measurement of the release agent using a differential scanning calorimeter (DSC). 60° C. to 90° C. is more preferred. The toner storability is enhanced when the melting point is at least 60° C. On the other hand, improvement in the low-temperature fixability is facilitated when the melting point is not more than 140° C.

The content of the release agent is preferably 3 to 30 mass parts per 100 mass parts of the binder resin. The fixing performance is readily improved when the release agent content is at least 3 mass parts. When, on the other hand, the release agent content is not more than 30 mass parts, deterioration in the toner during long-term use is suppressed and the image stability is readily enhanced.

The toner according to the present invention preferably contains a charge control agent.

Organometal complex compounds and chelate compounds are effective as negative-charging charge control agents and can be exemplified by monoazo metal complex compounds, acetylacetone metal complex compounds, metal complex compounds of aromatic hydroxycarboxylic acids, and metal complex compounds of aromatic dicarboxylic acids.

Specific examples of commercial products are Spilon Black TRH, T-77, and T-95 (Hodogaya Chemical Co., Ltd.) and BONTRON (registered trademark) S-34, S-44, S-54, E-84, E-88, and E-89 (Orient Chemical Industries Co., Ltd.).

A single one of these charge control agents may be used by itself or a combination of two or more may be used. Viewed in terms of the amount of charge on the toner, the content of these charge control agents, per 100 mass parts of the binder resin, is preferably 0.1 to 10.0 mass parts and is more preferably 0.1 to 5.0 mass parts.

Any of the following toners may be used as the toner according to the present invention: magnetic single-component toners, nonmagnetic single-component toners, and nonmagnetic two-component toners.

In the case of use as a magnetic single-component toner, a magnetic body is preferably used for the colorant. The magnetic body present in a magnetic single-component toner can be exemplified by magnetic iron oxides, such as magnetite, maghemite, and ferrite, and magnetic iron oxides that contain another metal oxide; metals such as Fe, Co, and Ni; and alloys and mixtures of these metals with a metal such as Al, Co, Cu, Pb, Mg, Ni, Sn, Zn, Sb, Be, Bi, Cd, Ca, Mn, Se, Ti, W, and V.

Magnetite is preferably used among the preceding, and its shape may be, for example, polyhedral, octahedral, hexahedral, spherical, acicular, flake, and so forth. However, low-anisotropy shapes, e.g., polyhedral, octahedral, hexahedral, and spherical, are preferred from the standpoint of increasing the image density.

The volume-average particle diameter of the magnetic body is preferably from 0.10 μm to 0.40 μm. When the volume-average particle diameter is at least 0.10 μm, magnetic body aggregation is inhibited and the uniformity of dispersion of the magnetic body in the toner is improved. The tinting strength of the toner is enhanced when the volume-average particle diameter is not more than 0.40 μm, and this is thus preferred.

The volume-average particle diameter of the magnetic body can be measured using a transmission electron microscope. Specifically, the toner particles to be observed are thoroughly dispersed in an epoxy resin, and a cured material is then obtained by curing for 2 days in an atmosphere with a temperature of 40° C. The obtained cured material is converted into a thin-section sample using a microtome, and, using a photograph at a magnification of 10,000× to 40,000× taken with a transmission electron microscope (TEM), the particle diameter of 100 magnetic bodies in the field of observation is measured. The volume-average particle diameter is determined based on the equivalent diameter of the circle equal to the projected area of the magnetic body. The particle diameter may also be measured using an image processing instrument.

The magnetic body used in the toner can be produced, for example, by the following method. An alkali, e.g., sodium hydroxide, is added—in an equivalent amount or more than an equivalent amount with reference to the iron component—to an aqueous solution of a ferrous salt to prepare an aqueous solution containing ferrous hydroxide. Air is blown in while keeping the pH of the prepared aqueous solution at 7 or above, and an oxidation reaction is carried out on the ferrous hydroxide while heating the aqueous solution to at least 70° C. to first produce seed crystals that will form the cores of magnetic bodies.

Then, an aqueous solution containing ferrous sulfate is added, at 1 equivalent based on the amount of addition of the previously added alkali, to the seed crystal-containing slurry. While maintaining the pH of the liquid at 5 to 10 and blowing in air, the reaction of the ferrous hydroxide is developed in order to grow magnetic iron oxide particles using the seed crystals as cores. At this point, the shape and magnetic properties of the magnetic body can be controlled by free selection of the pH, reaction temperature, and stirring conditions. The pH of the liquid transitions to the acidic side as the oxidation reaction progresses, but the pH of the liquid preferably does not drop below 5. The thusly obtained magnetic iron oxide particles are filtered, washed, and dried by standard methods to obtain a magnetic body.

In addition, when the toner is produced by a polymerization method, the magnetic body surface is preferably subjected to a hydrophobic treatment. When the surface treatment is carried out by a dry method, treatment with a coupling agent can be carried out on the surface of the washed, filtered, and dried magnetic body. When the surface treatment is carried out by a wet method, the coupling treatment can be carried out with redispersion of the material that has been dried after the completion of the oxidation reaction, or with redispersion, in a separate aqueous medium without drying, of the iron oxide obtained by washing and filtration after completion of the oxidation reaction.

Specifically, a silane coupling agent is added while thoroughly stirring the redispersion and a coupling treatment is carried out by raising the temperature after hydrolysis or by adjusting the pH of the dispersion after hydrolysis into the alkaline region. Among the alternatives, from the standpoint of carrying out a uniform surface treatment, the surface treatment preferably is carried out by directly reslurrying after completion of the oxidation reaction, filtration, and washing, but without drying.

To perform the surface treatment of the magnetic body by a wet method, i.e., in order to perform treatment with a coupling agent in an aqueous medium, the magnetic body is first thoroughly dispersed in an aqueous medium so as to convert it to the primary particle diameter and is stirred with, for example, a stirring blade, to prevent sedimentation and aggregation. The appropriate amount of coupling agent is then introduced into this aqueous medium and the surface treatment is performed while hydrolyzing the coupling agent. Also at this time, the surface treatment is more preferably carried out while stirring and while using a device such as a pin mill or line mill in order to bring about a thorough dispersion so as to avoid aggregation.

The aqueous medium here is a medium for which water is the major component. This can be specifically exemplified by water itself, water to which a small amount of a surfactant has been added, water to which a pH modifier has been added, and water to which an organic solvent has been added. The surfactant is preferably a nonionic surfactant, e.g., polyvinyl alcohol. The surfactant is preferably added at 0.1 to 5.0 mass % to the aqueous medium. The pH modifier can be exemplified by inorganic acids such as hydrochloric acid. The organic solvent can be exemplified by alcohols.

The coupling agents that can be used for the surface treatment of the magnetic body can be exemplified by silane coupling agents, titanium coupling agents, and so forth. Silane coupling agents are more preferably used and are represented by general formula (4).

$$R_mSiY_n \tag{4}$$

[In the formula, R represents an alkoxy group (preferably having 1 to 3 carbons); m represents an integer from 1 to 3; Y represents a functional group such as an alkyl group (preferably having 2 to 20 carbons), phenyl group, vinyl group, epoxy group, acryl group, methacryl group, and so forth; and n represents an integer from 1 to 3; with the proviso that m+n=4.]

The silane coupling agent represented by general formula (4) can be exemplified by vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, and n-octadecyltrimethoxysilane.

Among the preceding, the use of an alkyltrialkoxysilane coupling agent represented by the following general formula (5) is preferred from the standpoint of imparting a high hydrophobicity to the magnetic body.

$$C_pH_{2p+1}—Si—(OC_qH_{2q+1})_3 \tag{5}$$

[In the formula, p represents an integer from 2 to 20 and q represents an integer from 1 to 3.]

Hydrophobicity can be satisfactorily imparted to the magnetic body when p in the aforementioned formula is at least 2. When p is not more than 20, the hydrophobicity is satisfactory while magnetic body-to-magnetic body unification can also be inhibited. The reactivity of the silane coupling agent is excellent when q is not more than 3, which facilitates the execution of a satisfactory hydrophobing.

As a consequence, the use is preferred of an alkyltrialkoxysilane coupling agent in which p in the formula represents an integer from 2 to 20 (more preferably an integer from 3 to 15) and q represents an integer from 1 to 3 (more preferably 1 or 2).

In the case of use of a silane coupling agent as described above, treatment may be carried out with a single one or may be carried out using a plurality in combination. When the combination of a plurality is used, a separate treatment may be performed with each individual coupling agent or a simultaneous treatment may be carried out.

The total treatment amount with the coupling agent used is preferably 0.9 to 3.0 mass parts per 100 mass parts of the magnetic body, and the amount of the treatment agent is preferably adjusted in conformity to the surface area of the magnetic body, the reactivity of the coupling agent, and so forth.

Another colorant may be used in the toner other than a magnetic body.

The following are examples of the colorant for the case of use as a nonmagnetic single-component toner or nonmagnetic two-component toner.

Carbon blacks, e.g., furnace black, channel black, acetylene black, thermal black, lamp black, and so forth, may be used as a black pigment, and a magnetic powder, e.g., magnetite, ferrite, and so forth, may also be used as a black pigment.

A pigment or dye may be used as a colorant suitable for giving a yellow color. The pigments can be exemplified by C. I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, and 191, and C. I. Vat Yellow 1, 3, and 20. The dyes can be exemplified by C. I. Solvent Yellow 19, 44, 77, 79, 81, 82, 93, 98, 103, 104, 112, and 162. A single one of these may be used by itself or two or more may be used in combination.

A pigment or dye may be used as a colorant suitable for giving a cyan color. The pigments can be exemplified by C. I. Pigment Blue 1, 7, 15, 15:1, 15:2, 15:3, 15:4, 16, 17, 60, 62, and 66; C. I. Vat Blue 6; and C. I. Acid Blue 45. The dyes can be exemplified by C. I. Solvent Blue 25, 36, 60, 70, 93, and 95. A single one of these may be used by itself or two or more may be used in combination.

A pigment or dye may be used as a colorant suitable for giving a magenta color. The pigments can be exemplified by C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238, and 254; C. I. Pigment Violet 19; and C. I. Vat Red 1, 2, 10, 13, 15, 23, 29, and 35.

The magenta dyes can be exemplified by oil-soluble dyes such as C. I. Solvent Red 1, 3, 8, 23, 24, 25, 27, 30, 49, 52, 58, 63, 81, 82, 83, 84, 100, 109, 111, 121, and 122; C. I. Disperse Red 9; C. I. Solvent Violet 8, 13, 14, 21, and 27; and C. I. Disperse Violet 1, and by basic dyes such as C. I. Basic Red 1, 2, 9, 12, 13, 14, 15, 17, 18, 22, 23, 24, 27, 29, 32, 34, 35, 36, 37, 38, 39, and 40 and C. I. Basic Violet 1, 3, 7, 10, 14, 15, 21, 25, 26, 27, and 28. A single one of these may be used by itself or two or more may be used in combination.

Viewed from the standpoint of the mechanical strength of the toner, a magnetic toner that uses a magnetic body as colorant may have a weaker bonding strength at the interface between the binder resin and the magnetic iron oxide particle.

While the effects of the present invention are obtained with both magnetic toners and nonmagnetic toners, large effects are readily obtained for magnetic toners in particular with regard to mechanical strength.

Thus, the colorant preferably has a magnetic body. The content of the magnetic body, per 100 mass parts of the binder resin, is preferably from 30 mass parts to 120 mass parts and is more preferably from 40 mass parts to 110 mass parts. In addition, a colorant other than a magnetic body may be used, and the content of the non-magnetic body colorant is preferably from 1 mass parts to 20 mass parts per 100 mass parts of the binder resin.

An example of a toner production method is provided in the following, but the present invention is not limit to or by this. The toner according to the present invention must have an average circularity of at least 0.960 in order to perform highly reproducible measurements of the toner strength by nanoindentation. There is no particular limitation on the production method as long as this circularity is satisfied, and production may even be carried out by a pulverization method. However, toner production is preferably carried out in an aqueous medium, e.g., by a dispersion polymerization method, an association aggregation method, a dissolution suspension method, a suspension polymerization method, or an emulsion aggregation method. A toner that satisfies the advantageous properties of the present invention is readily obtained by the suspension polymerization method, which is thus more preferred.

In the suspension polymerization method, a polymerizable monomer composition is first obtained by bringing about a uniform dispersion of a colorant (and optionally a polymerization initiator, crosslinking agent, charge control agent, and other additives) in a polymerizable monomer that can form the binder resin. Then, using a suitable stirring device, the obtained polymerizable monomer composition is dispersed and granulated in a continuous layer (for example, an aqueous phase) that contains a dispersion stabilizer, and a polymerization reaction is run using a polymerization initiator to obtain a toner particle having the desired particle diameter.

Since the shape of the individual toner particles in the toner provided by this suspension polymerization method (also referred to in the following as "polymerized toner") is uniformly approximately spherical, a toner that satisfies the advantageous property prerequisites in the present invention is then readily obtained and measurement of the toner strength by nanoindentation may then also be carried out at high reproducibilities.

The polymerizable monomer can be exemplified by the following:

styrene monomers such as styrene, o-methylstyrene, m-methylstyrene, p-methylstyrene, p-methoxystyrene, and p-ethylstyrene; acrylate esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylate esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; as well as acrylonitrile, methacrylonitrile, and acrylamide. A single one of these monomers may be used by itself or a mixture of these monomers may be used.

Among the monomers given above, the use of a styrene monomer by itself or the use of a styrene monomer mixed with another monomer, e.g., an acrylate ester or methacrylate ester, facilitates control of the toner structure and facilitates improving the developing characteristics and durability of the toner and is thus preferred. In particular, the use of styrene and alkyl acrylate ester, or the use of styrene and alkyl methacrylate ester as the major component is more preferred. That is, the binder resin is preferably a styrene-acrylic resin.

The polymerization initiator used in toner production by a polymerization method preferably has a half-life in the polymerization reaction of from 0.5 hours to 30 hours. It is preferably used in an amount of addition of from 0.5 mass parts to 20 mass parts per 100 mass parts of the polymerizable monomer. When these conditions are met, a polymer having a maximum between a molecular weight from 5,000 to 50,000 can be obtained and a preferred strength and suitable melting characteristics can be imparted to the toner.

From the standpoint of the fixing performance and mechanical strength, the peak molecular weight (Mp(T)) of the toner is preferably from 10,000 to 35,000 and is more preferably from 15,000 to 30,000.

The specific polymerization initiator can be exemplified by the following: azo and diazo polymerization initiators such as 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, and peroxide-type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate, t-butyl peroxypivalate, di(2-ethylhexyl) peroxydicarbonate, and di(secondary-butyl) peroxydicarbonate.

t-Butyl peroxypivalate is preferred among the preceding.

A crosslinking agent may be added to toner production by a polymerization method, and the preferred amount of addition is from 0.001 mass parts to 15 mass parts per 100 mass parts of the polymerizable monomer.

A compound having two or more polymerizable double bonds is mainly used as this crosslinking agent. For example, a single one of the following or a mixture of two or more of the following may be used: an aromatic divinyl compound such as divinylbenzene, divinylnaphthalene, and so forth; carboxylate esters having two double bonds, e.g., ethylene glycol diacrylate, ethylene glycol dimethacrylate, and 1,3-butanediol dimethacrylate; divinyl compounds such as divinylaniline, divinyl ether, divinyl sulfide, and divinyl sulfone; and compounds having three or more vinyl groups.

A polar resin is preferably incorporated in the polymerizable monomer composition. Since the magnetic toner particle is produced in an aqueous medium in the suspension polymerization method, through the incorporation of a polar resin, a layer of the polar resin can be induced to form at the toner particle surface and a toner particle having a core/shell structure can then be obtained.

The degrees of freedom from core and shell design are increased by the presence of the core/shell structure. For example, by increasing the glass transition temperature of the shell, deteriorations in the durability (deterioration during long-term use), e.g., burying of the external additive, can be suppressed. In addition, by providing the shell with a shielding effect, the composition of the shell is easily made uniform and a uniform charge can then be brought about.

The polar resin for the shell layer can be exemplified by the homopolymers of styrene and its substituted forms, e.g., polystyrene and polyvinyltoluene; by styrene copolymers, e.g., styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate ester copolymer; and by polymethyl methacrylate, polybutyl methacrylate, polyvinyl acetate, polyethylene, polypropylene, polyvinyl butyral, silicone resins, polyester resins, styrene-polyester copolymers, polyacrylate-polyester copolymers, polymethacrylate-polyester copolymers, polyamide resins, epoxy resins, polyacrylic acid resins, terpene resins, and phenolic resins.

A single one of the preceding may be used by itself or a mixture of two or more may be used. A functional group, e.g., the amino group, carboxyl group, hydroxyl group, sulfonic acid group, glycidyl group, nitrile group, and so forth, may be introduced into these polymers. Polyester resins are preferred among the resins indicated above.

A suitable selection from saturated polyester resins, unsaturated polyester resins, or both may be used as the polyester resin.

An ordinary polyester resin structured from an alcohol component and an acid component may be used as the polyester resin, and examples of these two components are given in the following.

The dihydric alcohol component can be exemplified by ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, bisphenol derivatives represented by formula (A), hydrogenates of compounds represented by formula (A), diols represented by formula (B), and diols of hydrogenates of compounds represented by formula (B).

(A)

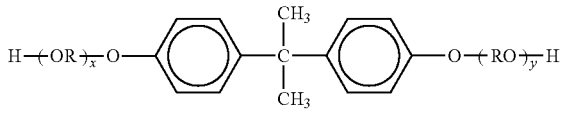

[In the formula, R is an ethylene or propylene group; x and y are each integers equal to or greater than 1; and the average value of x+y is 2 to 10.]

(B)

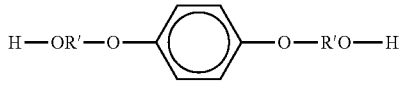

[In the formula, R' is

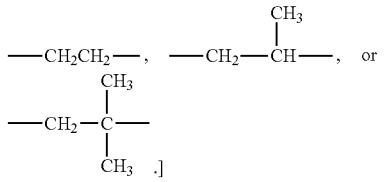

The aforementioned alkylene oxide adducts on bisphenol A, which exhibit excellent charging properties and environmental stability and which strike a balance with other electrophotographic properties, are particularly preferred for the dihydric alcohol component. For these particular compounds, the average number of moles of addition of the alkylene oxide is preferably from 2 to 10 in view of the fixing performance and toner durability.

The dibasic acid component can be exemplified by benzenedicarboxylic acids and their anhydrides, e.g., phthalic acid, terephthalic acid, isophthalic acid, and phthalic anhydride; alkyl dicarboxylic acids such as succinic acid, adipic acid, sebacic acid, and azelaic acid, and their anhydrides; succinic acid substituted by an alkyl or alkenyl group having 6 to 18 carbons, and their anhydrides; and unsaturated dicarboxylic acids such as fumaric acid, maleic acid, citraconic acid, and itaconic acid, and their anhydrides.

The trihydric and higher hydric alcohol component can be exemplified by glycerol, pentaerythritol, sorbitol, sorbitan, and the oxyalkylene ethers of novolac-type phenolic resins, while the tribasic and higher basic acid component can be exemplified by trimellitic acid, pyromellitic acid, 1,2,3,4-butanetetracarboxylic acid, and benzophenonetetracarboxylic acid and their anhydrides.

The polyester resin is preferably a polycondensate of an alcohol component and a carboxylic acid component that contains from 10 mol % to 50 mol %, with respect to the total carboxylic acid component, of a straight-chain aliphatic dicarboxylic acid having from 6 to 12 carbons.

Achieving a reduction in the softening point of the polyester resin, under a condition in which the peak molecular weight of the polyester resin is increased, is facilitated by the polyester resin having a carboxylic acid component that contains from 10 mol % to 50 mol %, with respect to the total carboxylic acid component, of a straight-chain aliphatic dicarboxylic acid having from 6 to 12 carbons. As a consequence, the toner strength is increased while maintaining the fixing performance.

Using 100 mol % for the total of the alcohol component and acid component in the polyester resin, preferably from 45 mol % to 55 mol % is the alcohol component.

The polyester resin can be produced using any catalyst, e.g., a tin catalyst, antimony catalyst, titanium catalyst, and so forth, while the use of a titanium catalyst is preferred.

From the standpoints of the developing performance, blocking resistance, and durability, the polar resin used for the shell preferably has a number-average molecular weight from 2,500 to 25,000. The number-average molecular weight can be measured by GPC.

The polar resin used for the shell preferably has an acid value from 1.0 mg KOH/g to 15.0 mg KOH/g and more preferably has an acid value from 2.0 mg KOH/g to 10.0 mg KOH/g. The formation of a uniform shell is facilitated by controlling the acid value into the indicated range.

From the standpoint of obtaining the effects provided by the shell layer to a satisfactory degree, the content of the polar resin for the shell layer is preferably from 2 mass parts to 20 mass parts per 100 mass parts of the binder resin.

A dispersion stabilizer is present in the aqueous medium in which the polymerizable monomer composition is dispersed, and a known surfactant or organic dispersing agent or inorganic dispersing agent can be used as this dispersion stabilizer. The use of inorganic dispersing agents is preferred among the preceding for the following reasons: inorganic dispersing agents provide a dispersion stabilizing action through steric hindrance and thus resist disruption of the stability even when the reaction temperature is changed; they are also easy to wash out; and they tend to not have negative effects on the toner.

Such inorganic dispersing agents can be exemplified by the multivalent metal salts of phosphoric acid, e.g., tricalcium phosphate, magnesium phosphate, aluminum phosphate, zinc phosphate, and hydroxyapatite; metal salts such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

These inorganic dispersing agents are preferably used at from 0.2 mass parts to 20 mass parts per 100 mass parts of the polymerizable monomer. A single one of these dispersion stabilizers may be used by itself or a plurality may be used in combination. A surfactant may be co-used at from 0.001 mass parts to 0.1 mass parts. When an inorganic dispersing agent is used, the inorganic dispersing agent may be used as such or, in order to obtain finer particles, the inorganic dispersing agent may be used by producing particles of the inorganic dispersing agent in the aqueous medium.

For example, for the case of tricalcium phosphate, an aqueous sodium phosphate solution and an aqueous calcium chloride solution are mixed under high-speed stirring to produce water-insoluble calcium phosphate, and a more uniform and finer dispersion is thereby made possible. In this case, water-soluble sodium chloride salt is produced as a by-product at the same time; however, the presence of a water-soluble salt in the aqueous medium inhibits the dissolution of the polymerizable monomer in the water and thereby inhibits the production of ultrafine toner particles during emulsion polymerization and is thus preferred.

The surfactant can be exemplified by sodium dodecylbenzene sulfate, sodium tetradecyl sulfate, sodium pentadecyl sulfate, sodium octyl sulfate, sodium oleate, sodium laurate, sodium stearate, and potassium stearate.

The polymerization temperature in the step of polymerizing the polymerizable monomer is set generally to at least 40° C. and preferably to a temperature from 50° C. to 90° C. When the polymerization is carried out in this temperature range, the release agent, which should be sealed in the interior, is precipitated through phase separation and is more completely encapsulated.

This is followed by a cooling step in which the polymerization reaction step is brought to an end by cooling from the reaction temperature of approximately 50° C. to 90° C. Cooling is preferably carried out gradually here so as to preserve the state of compatibility between the release agent and binder resin.

After the completion of polymerization of the polymerizable monomer, the obtained polymer particles are filtered, washed, and dried by known methods to obtain toner particles. The toner can be obtained by mixing the external additive into the toner particles as described above to attach the external additive to the toner particle surface. In addition, the coarse powder and fines present in the toner particles may also be cut by inserting a classification step in the production sequence.

The methods for measuring the various properties involved with the present invention are described in the following.

Method for Measuring the Toner Strength by Nanoindentation

The toner strength is measured by nanoindentation using a Picodenter HM500 from Fischer Instruments K.K. WIN—HCU is used for the software. A Vickers indenter (angle: 130°) is used for the indenter.

Figure 4:
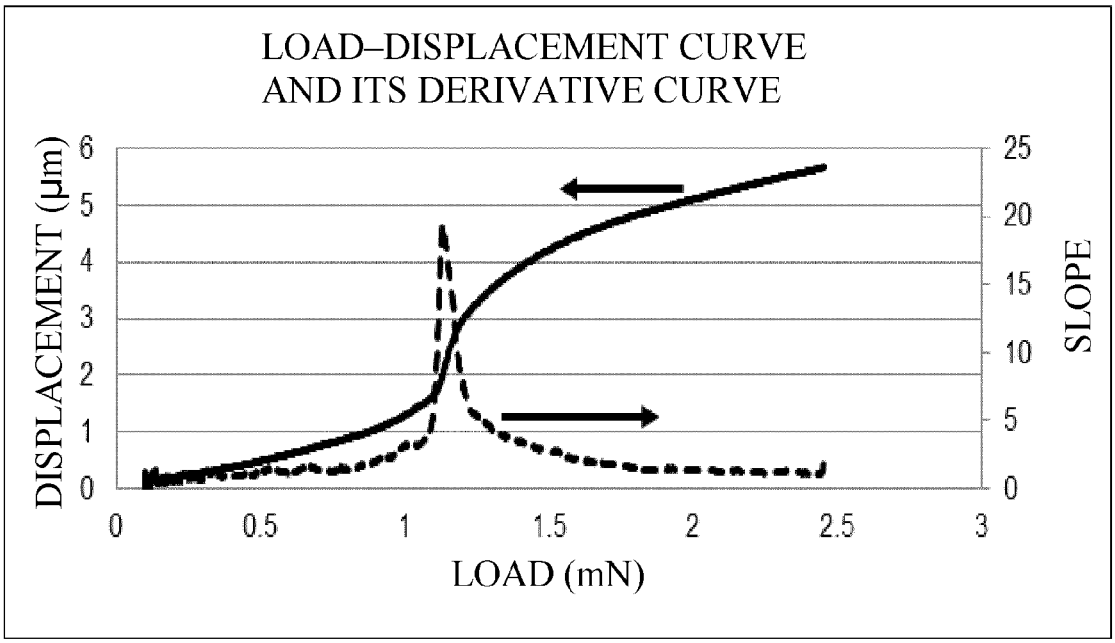
FIG. 4 is an example of a load-displacement curve obtained by a nanoindentation procedure and the differential curve provided by the differentiation of this curve by load.

The measurement consists of a step of pressing this indenter at a prescribed rate until a prescribed load is reached (referred to as the "indentation step" in the following). The toner strength is determined from the differential curve obtained by the differentiation, by load, of the load-displacement curve provided by this indentation step as shown in FIG. 4.

The microscope is first focused with the video camera screen connected to the microscope and displayed with the software. The target for focusing is the glass plate (hardness=3,600 N/mm$^2$) used for the Z-axis alignment described below. At this time, the objective lenses are focused in sequence from 5× to 20× and 50×. Subsequent to this, adjustment is carried out using the 50× objective lens.

The "approach parameter setting" process is then carried out using the aforementioned glass plate used for focusing as described above and the Z-axis alignment of the indenter is carried out. The glass plate is then replaced with an acrylic plate and the "indenter cleaning" process is carried out. This "indenter cleaning" process is a process in which the tip of the indenter is cleaned with a cotton swab moistened with ethanol and at the same time the indenter position specified by the software is brought into agreement with the indenter position on the hardware, i.e., XY-axis alignment of the indenter is performed.

Changeover to the toner-loaded microscope slide is then performed and the microscope is focused on the toner, which is the measurement target. The toner is loaded on the microscope slide using the following procedure.

First, the toner that is the measurement target is taken up by the tip of a cotton swab and the excess toner is sifted out at, for example, the edge of a bottle. The shaft of the cotton swab is then pressed against the edge of the microscope slide and the toner attached to the cotton swab is tapped off so as to form a single layer of the toner on the microscope slide.

The microscope slide bearing the toner single layer as described above is placed in the microscope; the toner is brought into focus with the 50× objective lens; and the tip of the indenter is positioned with the software so as to hit the center of a toner particle. The selected toner particles are limited to particles for which both the major diameter and minor diameter are approximately the D4 (μm) of the toner±1.0 μm.

The measurement is performed by carrying out the indentation step under the following conditions.

Indentation Step

Maximum indentation load=2.5 mN

Indentation time=100 seconds

A load-displacement curve is constructed by this measurement using the load (mN) for the horizontal axis and the displacement (μm) for the vertical axis.

The procedure for determining "the load that provides the largest slope", which is defined as the toner strength in the present invention, is to use the load at which the value of the derivative assumes the maximum value in the differential curve provided by differentiating the load-displacement curve by load. Considering the accuracy of the data, the load range from 0.20 mN to 2.30 mN is used to determine the differential curve.

This measurement is performed on 30 toner particles and the arithmetic average value is used.

In this measurement, the aforementioned "indenter cleaning" process (also including XY-axis alignment of the indenter) is always performed on each single particle measured.

Method for Measuring the Fxing Ratio of the External Additive 20 g of "Contaminon N" (10 mass % aqueous solution of a neutral pH 7 detergent for cleaning precision measurement instrumentation, formed from a nonionic surfactant, anionic surfactant, and organic builder) is weighed into a 50-mL vial and mixed with 1 g of toner.

This is placed in a "KM Shaker" (model: V. SX) from Iwaki Co., Ltd., and shaking is carried out for 30 seconds with the speed set to 50. This serves to transfer the external additive, as a function of the state of immobilization of the external additive, from the toner particle surface into the dispersion.

Subsequent to this, and in the case of a magnetic toner, the external additive that has transferred into the supernatant is separated while the toner particles are held using a neodymium magnet, and the sedimented toner is dried by vacuum drying (40° C./24 hours) to provide the sample.

For the case of a nonmagnetic toner, the toner is separated using a centrifugal separator (H-9R, Kokusan Co., Ltd.) (5 minutes at 100 rpm) from the external additive that has transferred into the supernatant.

The toner is converted into a pellet using the press molder described below to provide the sample. An element characteristic of the external agent that is the target of the analysis is quantitated, on the toner sample both before and after the execution of the aforementioned treatment, using the wavelength-dispersive x-ray fluorescence analysis (XRF) indicated below. The amount of external additive not transferred into the supernatant by the aforementioned treatment and remaining on the toner particle surface is determined using the formula given below, and this is used as the fixing ratio. The arithmetic average for 100 samples is used.

(i) Example of the Instrumentation Used

3080 Fluorescent X-ray Analyzer (Rigaku Corporation)

(ii) Sample Preparation

A sample press molder from Maekawa Testing Machine Mfg. Co., Ltd. is used for sample preparation. Conversion into the pellet is carried out by introducing 0.5 g of the toner into an aluminum ring (model number: 3481E1) and pressing for 1 minute with the load set to 5.0 tons.

(iii) Measurement Conditions

Measurement diameter: 10Ø

Measurement potential: 50 kV voltage, 50 to 70 mA 20 angle: 25.12°

Crystal plate: LiF

Measurement time: 60 seconds (iv) Procedure for Determining the Fixing Ratio for the External Additive

[Formula] Fixing ratio(%) for the external additive= (intensity of the external additive-originating element for the toner after treatment/intensity of the external additive-originating element for the toner before treatment)×100

For toner having a plurality of external additives, the fixing ratio is first determined for each external additive by itself and the average of these percentage values is used as the fixing ratio.

Method for Measuring the Coverage Ratio X1 by the External Additive

The coverage ratio X1 of the toner particle surface by the external additive is calculated as described in the following.

Elemental analysis of the toner surface is carried using the following instrument under the following conditions.

Measurement instrument: Quantum 2000 (product name, Ulvac-Phi, Inc.)

X-ray source: monochrome Al Kα

X-ray setting: 100 μmØ (25 W (15 kV))

Photoelectron extraction angle: 45°

Neutralization conditions: combined use of neutralizing gun and ion gun

Region of analysis: 300 μm×200 μm

Pass energy: 58.70 eV

Step size: 1.25 eV

Analysis software: Multipak (PHI)

For example, when the coverage ratio by silica fine particles is to be determined, the peaks for C is (B. E. 280 to 295 eV), 0 is (B. E. 525 to 540 eV), and Si 2p (B. E. 95 to 113 eV) are used to calculate the quantitative value for the Si atom.

The quantitative value obtained here for the Si atom is designated Y1.

Then, proceeding as in the aforementioned elemental analysis of the toner surface, elemental analysis is performed on the silica fine particle itself, and the quantitative value thereby obtained for the Si atom is designated Y2.

The coverage ratio X1 of the toner surface by the silica fine particle is defined by the following formula using the above Y1 and Y2.

$$X1(\text{area }\%)=(Y1/Y2)\times 100$$

The measurement is performed 100 times on the same sample, and the arithmetic average value thereof is used.

When a plurality of external additives have been used, the coverage ratio X1 is determined for each external additive and these are summed to give the value used for X1.

If the external additive used for external addition can be acquired, the measurement for the determination of the quantitative value Y2 may be carried out using this.

The following procedure is used to separate the external additive from the toner particle when the external additive as separated from the toner particle surface is to be used as the measurement sample.

1) For Magnetic Toner

A dispersion medium is first prepared by introducing 6 mL of Contaminon N (10 mass % aqueous solution of a neutral pH 7 detergent for cleaning precision measurement instrumentation, formed from a nonionic surfactant, anionic surfactant, and organic builder, Wako Pure Chemical Industries, Ltd.) into 100 mL of deionized water. 5 g of the toner is added to this dispersion medium and dispersion is carried out for 5 minutes with an ultrasound disperser (VS-150, AS ONE Corporation). Then, after setting into a "KM Shaker" (model: V. SX) from Iwaki Co., Ltd., shaking is carried out for 20 minutes using the condition of 350 oscillations per minute.

The toner particles are subsequently sequestered using a neodymium magnetic and the supernatant is collected. The external additive is recovered by drying this supernatant. This process is carried out repeatedly when a sufficient amount of the external additive cannot be recovered.

When a plurality of external additives are used, the external additives may be sorted from the recovered external additive using, for example, a centrifugal separation procedure.

2) For Nonmagnetic Toner

A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N are introduced into a centrifugal separation tube to prepare a dispersion. 1 g of the toner is added to this dispersion, and clumps of the toner are broken up using, for example, a spatula.

Using the shaker referenced above, the centrifugal separation tube is shaken for 20 minutes using a condition of 350 oscillations per minute. After shaking, the solution is transferred over to a glass tube (50 mL) for swing rotor service, and centrifugal separation is performed in a centrifugal separator (H-9R, Kokusan Co., Ltd.) using conditions of 3,500 rpm and 30 minutes. In the glass tube after centrifugation separation, the toner is present in the uppermost layer and the external additive is present in the lower layer aqueous solution. The lower layer aqueous solution is recovered; centrifugal separation is performed to separate the sucrose from the external additive; and the external additive is collected. Centrifugal separation may be carried out repeatedly as necessary, and, once a satisfactory separation has been obtained, the dispersion is dried and the external additive is collected.

As with magnetic toner, when a plurality of external additives are used, the external additives may be sorted from the recovered external additive using, for example, a centrifugal separation procedure.

Method for Measuring the Number-Average Particle Diameter (D1) of the Primary Particles of the External Additive The number-average particle diameter of the primary particles of the external additive from the toner is determined from the image of the external additive on the toner particle surface acquired using an Hitachi S-4800 ultrahigh resolution field emission scanning electron microscope (Hitachi High-Technologies Corporation). The conditions for image acquisition with the S-4800 are as follows.

(1) Specimen Preparation

An electroconductive paste is spread in a thin layer on the specimen stub (15 mm×6 mm aluminum specimen stub) and the toner is sprayed onto this. Blowing with air is additionally performed to remove excess toner from the specimen stub and carry out thorough drying. The specimen stub is set in the specimen holder and the specimen stub height is adjusted to 36 mm with the specimen height gauge.

(2) Setting the Conditions for Observation with the S-4800

Calculation of the number-average particle diameter of the primary particles of the external additive is carried out using the images obtained by backscattered electron image observation with the S-4800. The particle diameter of the external additive can be measured with excellent accuracy using the backscattered electron image because charge up of the external additive is less than for the secondary electron image.

Liquid nitrogen is introduced to the brim of the anti-contamination trap attached to the S-4800 housing and standing for 30 minutes is carried out. The "PC-SEM" of the S-4800 is started and flashing is performed (the FE tip, which is the electron source, is cleaned). The acceleration voltage display area in the control panel on the screen is clicked and the [Flashing] button is pressed to open the flashing execution dialog.

A flashing intensity of 2 is confirmed and execution is carried out. The emission current due to flashing is confirmed to be 20 to 40 μA. The specimen holder is inserted in the specimen chamber of the S-4800 housing. [Home] is pressed on the control panel to transfer the specimen holder to the observation position.

The acceleration voltage display area is clicked to open the HV setting dialog and the acceleration voltage is set to [0.8 kV] and the emission current is set to [20 μA]. In the [Base] tab of the operation panel, signal selection is set to [SE]; [Upper (U)] and [+BSE] are selected for the SE detector; and [L.A. 100] is selected in the selection box to the right of [+BSE] to go into the observation mode using the backscattered electron image.

Similarly, in the [Base] tab of the operation panel, the probe current of the electron optical system condition block is set to [Normal]; the focus mode is set to [UHR]; and WD is set to [3.0 mm]. The [ON] button in the acceleration voltage display area of the control panel is pushed to apply the acceleration voltage.

(3) Calculation of the Number-average Particle Diameter (D1) of the External Additive (the "da" Used in the Calculation of the Theoretical Coverage Ratio)

The magnification is set to 100,000× (100 k) by dragging within the magnification indicator area of the control panel. The [COARSE] focus knob on the operation panel is turned and adjustment of the aperture alignment is performed when some degree of focus has been obtained. [Align] is clicked in the control panel and the alignment dialog is displayed and [Beam] is selected. The displayed beam is migrated to the center of the concentric circles by turning the STIGMA/ALIGNMENT knobs (X, Y) on the operation panel.

[Aperture] is then selected and the STIGMA/ALIGNMENT knobs (X, Y) are turned one at a time to adjust so as to stop the motion of the image or minimize the motion. The aperture dialog is closed and focusing is done with the autofocus. This operation is repeated an additional two times to achieve focus.

After this, the average particle diameter is determined by measuring the particle diameter on at least 300 of the external additive on the toner particle surface. Because the external additive may also be present as aggregated clumps, the number-average particle diameter (D1) of the primary particles of the external additive is obtained by determining the maximum diameter of external additive that can be confirmed to be the primary particle and taking the arithmetic average of the obtained maximum diameters.

When a plurality of external additives are used, elemental analysis is preliminarily performed using an energy-dispersive x-ray analyzer (EDAX), and the number-average particle diameter of the primary particles of each external additive is determined after the species of the external additive on the toner surface has been identified.

When determining the number-average particle diameter by observation of the surface is problematic, the number-average particle diameter measured in advance on each external additive may be used. In this case, each particular external additive as such is observed with a transmission electron microscope and the long diameter of 100 particles is measured and the number-average particle diameter is determined.

Method for Measuring the Flowability (Total Energy) of the Toner (A) Measurement of the Total Energy The Total Energy is measured using an "FT4 Powder Rheometer power flowability analyzer" (Freeman Technology, also abbreviated as FT4 in the following).

The measurement is specifically carried out using the following procedure.

In all the procedures, a blade with a diameter of 48 mm provided for use with the FT4 is used for the propeller-type blade (model number: C210, material: SUS, also abbreviated as the "blade" in the following). The rotational axis of this propeller-type blade is present in the perpendicular direction in the center of a 48 mm×10 mm blade plate, and the blade plate is smoothly twisted counterclockwise so that both outermost edges (the locations 24 mm from the rotational axis) are at 70° and the locations at 12 mm from the rotational axis are at 35°.

A cylindrical split vessel provided for use with the FT4 (model number: C203, material: glass, diameter: 50 mm, volume: 160 mL, height from the bottom to the split: 82 mm, also abbreviated as the "vessel" in the following) is used for the measurement vessel.

(1) Compression Procedure (a) Preliminary Test: The compression test piston is mounted in the main unit. Approximately 50 mL of the toner (mass measured in advance) is introduced into the measurement vessel, and the piston is lowered at 0.5 mm/second to compress the toner. The descent is stopped once the load on the piston reaches 0.88 kPa, and holding is carried out in this state for 20 seconds. The volume of the compressed toner is read from the scale on the vessel.

(b) The measurement vessel is filled with toner (the toner used in the preliminary test is not used; fresh toner is used) in one-fourth of the amount, calculated from the preliminary test, for which the volume of the compressed toner corresponds to 180 mL, and the same procedure as in the preliminary test is performed.

(c) The procedure in (b) is carried out an additional three times (for a total of four times) (with supplementary additions of toner).

(d) The compressed toner layer is sectioned at the split in the measurement vessel and the upper portion of the powder layer is removed.

(2) Procedure for Measuring the Total Energy (a) The propeller-type blade is mounted in the main unit. The propeller-type blade is rotated counterclockwise with respect to the powder layer surface (direction whereby the powder layer is pressed in by blade rotation) to provide a peripheral velocity, at the outermost edge of the blade, of 10 mm/second. This blade is inserted in the perpendicular direction, at an insertion velocity that provides a formed angle of 5°, from the powder layer surface to a position 10 mm from the bottom of the powder layer. After this, insertion is carried out, at an insertion velocity that provides a formed angle of 2° for the insertion velocity in the perpendicular direction into the powder layer, to a position 1 mm from the bottom of the powder layer using clockwise rotation with respect to the powder layer surface at a peripheral velocity, at the outermost edge of the blade, of 60 mm/second.

Withdrawal is carried out by moving the blade to a position 100 mm from the bottom of the powder layer at a velocity at which the formed angle is 5°. Once the withdrawal is complete, the toner sticking to the blade is knocked off by small rotations of the blade back and forth between clockwise and counterclockwise.

(b) The procedure in (2)-(a) is repeated an additional six times (for a total of seven times), and the Total Energy is taken to be the sum of the perpendicular load and rotational torque obtained at the final time when the blade is inserted to a position 10 mm from the bottom of the powder layer from a position 100 mm from the bottom of the powder layer.

Method for Measuring the Methanol Wettability of the Toner

The methanol wettability of the toner was measured using a methanol addition-transmittance curve. An example of the measurement instrumentation is the "WET-100P" powder wettability tester from Rhesca Co., Ltd. The specific measurement procedure can be exemplified by the method provided as an example in the following.

First, 70 mL of aqueous methanol composed of 30 volume % methanol and 70 volume % water is introduced into a flask, and dispersion is performed for 5 minutes with an ultrasound disperser in order to remove, e.g., air bubbles in this measurement sample. 0.50 g of the toner to be examined is exactly weighed and added to this to prepare the sample solution for measurement of toner hydrophobicity.

Methanol is then continuously added at a dripping rate of 1.3 mL/minute while stirring this measurement sample solution at a rate of 6.67 m/second; the transmittance of light having a wavelength of 780 nm is measured; a methanol addition-transmittance curve is constructed; and the methanol concentration at which the transmittance is 40% is measured.

A cylindrical flask of 1.75 mm glass and having a diameter of 5 cm is used for the flask in the measurement, and a fluororesin-coated spindle-shaped magnetic stirrer having a length of 25 mm and a maximum diameter of 8 mm is used.

Method for Measuring the Average Circularity of the Toner

The average circularity of the toner is measured using an "FPIA-3000" (Sysmex Corporation), a flow-type particle image analyzer, and using the measurement and analysis conditions from the calibration process.

The specific measurement method is as follows. First, 20 mL of deionized water from which solid impurities and so forth have been preliminarily removed, is introduced into a glass container. To this is added as dispersing agent 0.2 mL of a dilution prepared by the three-fold (mass) dilution with deionized water of "Contaminon N" (10 mass % aqueous solution of a neutral pH 7 detergent for cleaning precision measurement instrumentation, formed from a nonionic surfactant, anionic surfactant, and organic builder, Wako Pure Chemical Industries, Ltd.).

0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be from 10° C. to 40° C. A benchtop ultrasound cleaner/disperser that has an oscillation frequency of 50 kHz and an electrical output of 150 W (for example, the "VS-150" (Velvo-Clear Co., Ltd.)) is used as the ultrasound disperser, and a prescribed amount of deionized water is introduced into the water tank and 2 mL of Contaminon N is added to the water tank.

The previously cited flow particle image analyzer fitted with a "LUCPLFLN" objective lens (20×, numerical aperture: 0.40) is used for the measurement, and "PSE-900A" (Sysmex Corporation) particle sheath is used for the sheath solution. The dispersion prepared according to the procedure described above is introduced into the flow particle image analyzer and 3,000 toner particles are measured according to total count mode in HPF measurement mode. The average circularity of the toner particles is determined with the binarization threshold value during particle analysis set at 85% and the analyzed particle diameter limited to a circle-equivalent diameter of from 1.985 μm to less than 39.69 μm.

For this measurement, automatic focal point adjustment is performed prior to the start of the measurement using reference latex particles (for example, a dilution with deionized water of "RESEARCH AND TEST PARTICLES Latex Microsphere Suspensions 5200A", Duke Scientific Corporation). After this, focal point adjustment is preferably performed every two hours after the start of measurement.

In the present invention, the flow-type particle image analyzer used had been calibrated by Sysmex Corporation and had been issued a calibration certificate by Sysmex Corporation. The measurements are carried out under the same measurement and analysis conditions as when the calibration certification was received, with the exception that the analyzed particle diameter was limited to a circle-equivalent diameter of from 1.985 μm to less than 39.69 μm.

The "FPIA-3000" flow-type particle image analyzer (Sysmex Corporation) uses a measurement principle based on taking a still image of the flowing particles and performing image analysis. The sample added to the sample chamber is delivered by a sample suction syringe into a flat sheath flow cell. The sample delivered into the flat sheath flow is sandwiched by the sheath liquid to form a flat flow.

The sample passing through the flat sheath flow cell is exposed to stroboscopic light at an interval of 1/60 second, thus enabling a still image of the flowing particles to be photographed. Moreover, since flat flow is occurring, the photograph is taken under in-focus conditions. The particle image is photographed with a CCD camera; the photographed image is subjected to image processing at an image processing resolution of 512×512 pixels (0.37×0.37 μm per pixel); contour definition is performed on each particle image; and the projected area S, the periphery length L, and so forth are measured on the particle image.

The circle-equivalent diameter and the circularity are determined using this area S and periphery length L. The circle-equivalent diameter is the diameter of the circle that has the same area as the projected area of the particle image, and the circularity is defined as the value provided by dividing the circumference of the circle determined from the circle-equivalent diameter by the periphery length of the particle's projected image and is calculated using the following formula.

$$\text{Circularity}=2\times(\pi\times S)^{1/2}/L$$

The circularity is 1.000 when the particle image is a circle, and the value of the circularity declines as the degree of unevenness in the periphery of the particle image increases. After the circularity of each particle has been calculated, the circularity range from 0.200 to 1.000 is divided into 800 intervals and the arithmetic average value of the obtained circularities is calculated and this value is used as the average circularity.

Method for Measuring the Weight-Average Particle Diameter (D4)

Using a "Coulter Counter Multisizer 3" (registered trademark, Beckman Coulter, Inc.), a precision particle size distribution measurement instrument operating on the pore electrical resistance method and equipped with a 100 μm aperture tube, and the accompanying dedicated software, i.e., "Beckman Coulter Multisizer 3 Version 3.51" (Beckman Coulter, Inc.), for setting the measurement conditions and analyzing the measurement data, the weight-average particle diameter (D4) of the toner was determined by performing the measurement in 25,000 channels for the number of effective measurement channels and analyzing the measurement data.

The aqueous electrolyte solution used for the measurements is prepared by dissolving special-grade sodium chloride in deionized water to provide a concentration of approximately 1 mass %, and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL round-bottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with deionized water of "Contaminon N" (10 mass % aqueous solution of a neutral pH 7 detergent for cleaning precision measurement instrumentation, formed from a nonionic surfactant, anionic surfactant, and organic builder, Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W and equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "arithmetic diameter" on the analysis/volumetric statistical value (arithmetic average) screen is the weight-average particle diameter (D4).

Method for Measuring the Peak Molecular Weight Mp(T) of the Toner and the Peak Molecular Weight Mp(P) of the Amorphous Polyester The molecular weight distribution of the THF-soluble matter in the toner and amorphous polyester are measured by gel permeation chromatography (GPC) as follows.

First, the sample is dissolved in tetrahydrofuran (THF) over 24 hours at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to a THF-soluble component concentration of approximately 0.8 mass %. The measurement is performed under the following conditions using this sample solution.

Instrument: HLC8120 GPC (detector: RI) (Tosoh Corporation)

Columns: 7-column train of Shodex KF-801, 802, 803, 804, 805, 806, and 807

(Showa Denko K.K.)

Eluent: tetrahydrofuran (THF)

Flow rate: 1.0 mL/minute

Oven temperature: 40.0° C.

Sample injection amount: 0.10 mL

The molecular weight of the sample is determined using a calibration curve constructed using polystyrene resin standards (for example, product name: "TSK Standard Polystyrene F-850, F-450, F-288, F-128, F-80, F-40, F-20, F-10, F-4, F-2, F-1, A-5000, A-2500, A-1000, and A-500", Tosoh Corporation).

Method for Measuring the Acid Value Av of the Amorphous Polyester

The acid value is the number of milligrams of potassium hydroxide required to neutralize the acid present in 1 g of a sample. The acid value of the amorphous polyester is measured in accordance with JIS K 0070-1992 and in specific terms is measured according to the following procedure.

(1) Reagent Preparation

A phenolphthalein solution is obtained by dissolving 1.0 g of phenolphthalein in 90 mL of ethyl alcohol (95 volume %) and bringing to 100 mL by adding deionized water.

7 g of special-grade potassium hydroxide is dissolved in 5 mL of water and this is brought to 1 L by the addition of ethyl alcohol (95 volume %). This is introduced into an alkali-resistant container avoiding contact with, for example, carbon dioxide, and allowed to stand for 3 days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the aforementioned phenolphthalein solution are added, and titration is performed using the potassium hydroxide solution. The 0.1 mol/L hydrochloric acid used is prepared in accordance with JIS K 8001-1998.

(2) Procedure (A) Main Test 2.0 g of a sample of the pulverized amorphous polyester is exactly weighed into a 200-mL Erlenmeyer flask and 100 mL of a toluene/ethanol (2:1) mixed solution is added and dissolution is carried out over 5 hours. Several drops of the aforementioned phenolphthalein solution are added as indicator and titration is performed using the aforementioned potassium hydroxide solution. The titration endpoint is taken to be persistence of the faint pink color of the indicator for approximately 30 seconds.

(B) Blank Test

The same titration as in the above procedure is run, but without using the sample (that is, with only the toluene/ethanol (2:1) mixed solution).

(3) The Acid Value is Calculated by Substituting the Obtained Results into the Following Formula.

$$A=[(C-B)\times f\times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: sample (g).

Method for Measuring the Hydroxyl Value OHv of the Amorphous Polyester

The hydroxyl value is the number of milligrams of potassium hydroxide required to neutralize the acetic acid bonded with the hydroxyl group when 1 g of the sample is acetylated. The hydroxyl value of the amorphous polyester is measured based on JIS K 0070-1992 and in specific terms is measured according to the following procedure.

(1) Reagent Preparation 25 g of special-grade acetic anhydride is introduced into a 100-mL volumetric flask; the total volume is brought to 100 mL by the addition of pyridine; and thorough shaking then provides the acetylation reagent. The obtained acetylation reagent is stored in a brown bottle isolated from contact with, e.g., humidity, carbon dioxide, and so forth.

A phenolphthalein solution is obtained by dissolving 1.0 g of phenolphthalein in 90 mL of ethyl alcohol (95 vol %) and bringing to 100 mL by the addition of deionized water.

35 g of special-grade potassium hydroxide is dissolved in 20 mL of water and this is brought to 1 L by the addition of ethyl alcohol (95 vol %). After standing for 3 days in an alkali-resistant container isolated from contact with, e.g., carbon dioxide, filtration is performed to obtain a potassium hydroxide solution. The obtained potassium hydroxide solution is stored in an alkali-resistant container. The factor for this potassium hydroxide solution is determined as follows: 25 mL of 0.5 mol/L hydrochloric acid is taken to an Erlenmeyer flask; several drops of the above-described phenolphthalein solution are added; titration is performed with the potassium hydroxide solution; and the factor is determined from the amount of the potassium hydroxide solution required for neutralization. The 0.5 mol/L hydrochloric acid used is prepared in accordance with JIS K 8001-1998.

(2) Procedure (A) Main Test

A 1.0 g sample of the pulverized amorphous polyester is exactly weighed into a 200-mL roundbottom flask and exactly 5.0 mL of the above-described acetylation reagent is added from a whole pipette. When the sample is difficult to dissolve in the acetylation reagent, dissolution is carried out by the addition of a small amount of special-grade toluene.

A small funnel is mounted in the mouth of the flask and heating is then carried out by immersing about 1 cm of the bottom of the flask in a glycerol bath at approximately 97° C. In order at this point to prevent the temperature at the neck of the flask from rising due to the heat from the bath, thick paper in which a round hole has been made is preferably mounted at the base of the neck of the flask.

After 1 hour, the flask is taken off the glycerol bath and allowed to cool. After cooling, the acetic anhydride is hydrolyzed by adding 1 mL of water from the funnel and shaking. In order to accomplish complete hydrolysis, the flask is again heated for 10 minutes on the glycerol bath. After cooling, the funnel and flask walls are washed with 5 mL of ethyl alcohol.

Several drops of the above-described phenolphthalein solution are added as the indicator and titration is performed using the above-described potassium hydroxide solution. The endpoint for the titration is taken to be the point at which the pale pink color of the indicator persists for approximately 30 seconds.

(B) Blank Test

Titration is performed using the same procedure as described above, but without using the amorphous polyester sample.

(3) The Hydroxyl Value is Calculated by Substituting the Obtained Results into the Following Formula.

$$A=[\{(B-C)\times 28.05\times f\}/S]+D$$

Here, A: the hydroxyl value (mg KOH/g); B: the amount of addition (mL) of the potassium hydroxide solution in the blank test; C: the amount of addition (mL) of the potassium hydroxide solution in the main test; f: the factor for the potassium hydroxide solution; S: the sample (g); and D: the acid value (mg KOH/g) of the amorphous polyester.

Measurement of the Tg of the Toner Particle

The Tg of the toner particle is measured based on ASTM D 3418-82 using a "Q2000" differential scanning calorimeter (TA Instruments). Temperature correction in the instrument detection section is performed using the melting points of indium and zinc, and the amount of heat is corrected using the heat of fusion of indium.

Specifically, approximately 2 mg of the sample is exactly weighed out and this is introduced into an aluminum pan, and the measurement is run at a ramp rate of 10° C./minute in the measurement temperature range from 30° C. to 200° C. using an empty aluminum pan as reference. The measurement is carried out by initially raising the temperature to 200° C., then cooling to 30° C., and then reheating. The change in the specific heat is obtained in the temperature range of 40° C. to 100° C. in this second heating process. In this case, the glass transition temperature Tg is taken to be the point at the intersection between the differential heat curve and the line for the midpoint for the baselines for prior to and subsequent to the appearance of the change in the specific heat.

Method for Measuring the True Density of the Toner and External Additive

The true density of the toner and external additive is measured using an "AccuPyc 1330" dry-process automatic pycnometer from Shimadzu Corporation, in accordance with the operating manual provided with this instrument.

Measurement of the Content of External Additive in the Toner

The external additive content in the toner is described using silica fine particles as an example of the external additive.

(1) Quantitation of the Content of Silica Fine Particles in the Toner (Standard Addition Method)

First, 3 g of the toner is introduced into an aluminum ring having a diameter of 30 mm and a pellet is fabricated at a pressure of 10 tons. The intensity for silicon (Si) is determined (Si intensity-1) by wavelength-dispersive x-ray fluorescence analysis (XRF). While the measurement conditions should be optimized for the XRF instrument used, all of the intensity measurements in a measurement series are run under the same conditions. Then, 1.0 mass part, per 100 mass parts of the toner particle, of silica fine particles having a number-average primary particle diameter of 12 nm is added to the toner particles and mixing is performed using a coffee mill. After mixing, pelletization is carried out as above and the intensity for Si is determined as above (Si intensity-2). The intensity for Si is determined using the same procedure for samples provided by the addition with mixing of 2.0 mass parts and 3.0 mass parts of the silica fine particles per 100 mass parts of the toner particle (Si intensity-3, Si intensity-4). Using Si intensities-1 to -4, the silica content (mass %) in the toner is determined by the method of standard addition.

(2) Separation of the Silica Fine Particles from the Toner

The content of the silica fine particles in the toner particle is quantitated using the following procedure.

5 g of the toner is weighed into a 200-mL lidded plastic cup using a precision scale; 100 mL of methanol is added; and dispersion is carried out for 5 minutes using an ultrasound disperser. The toner is captured using a neodymium magnet and the supernatant is discarded. The process of dispersion in methanol and discarding the supernatant is carried out three times, after which the following materials are added and gentle mixing is performed followed by standing at quiescence for 24 hours.

100 mL 10% NaOH

Several drops of "Contaminon N" (10 mass % aqueous solution of a neutral pH 7 detergent for cleaning precision measurement instrumentation, formed from a nonionic surfactant, anionic surfactant, and organic builder, Wako Pure Chemical Industries, Ltd.)

Separation is then again carried out using a neodymium magnet. Repeated washing with distilled water is performed at this point so NaOH does not remain present. The recovered particles are thoroughly dried using a vacuum drier to yield a particle A. This process serves to dissolve and remove the externally added silica fine particles.

(3) Measurement of the Si Intensity in Particle A 3 g of particle A is introduced into an aluminum ring having a diameter of 30 mm; a pellet is fabricated using a pressure of 10 tons; and the Si intensity (Si intensity-5) is determined by wavelength-dispersive x-ray fluorescence analysis (XRF). The silica content (mass %) in particle A is calculated using this Si intensity-5 and the Si intensities-1 to -4 used in the quantitation of the silica content in the toner. The amount of the externally added silica fine particles (content of the external additive in the toner) is calculated by substituting each of the quantitative values into the following formula.

Amount of externally added silica fine particles(mass %)=silica content in the toner(mass %)−silica content in particle A(mass %)

When a plurality of external additives are used, the determination according to the procedure described above is performed for each external additive and the total external additive content is acquired by summing these results.

EXAMPLES

The present invention is described more specifically below using examples, but these in no way limit the present invention. The number of parts in the blends in the following are on a mass basis unless specifically indicated otherwise.

Amorphous Polyester (APES1) Production Example

The starting monomer, with the carboxylic acid component and alcohol component adjusted as shown in Table 1, was introduced into a reaction tank fitted with a nitrogen introduction line, a water separator, a stirrer, and a thermocouple, and 1.5 parts of an esterification catalyst (tin octylate) was subsequently added per 100 parts of the overall amount of the monomer.

Then, after rapidly raising the temperature to 180° C. at normal pressure under a nitrogen atmosphere, a polycondensation was run while distilling off the water while heating from 180° C. to 210° C. at a rate of 10° C./hour.

After 210° C. had been reached, the pressure within the reaction tank was reduced to 5 kPa or below, and a polycondensation was run under conditions of 210° C. and 5 kPa or below to obtain an amorphous polyester (APES1).

The polymerization time was adjusted so as to provide the value in Table 1 for the peak molecular weight of the amorphous polyester (APES1). The properties are given in Table 1.

Amorphous Polyester (APES2) Production Example

Amorphous polyester APES2 was obtained proceeding as for amorphous polyester (APES1), but changing the starting monomer and amounts used as indicated in Table 1. The properties are given in Table 1.

Treated Magnetic Body Production Example

The following were mixed into an aqueous ferrous sulfate solution to produce an aqueous solution containing ferrous hydroxide: a sodium hydroxide solution at 1.00 to 1.10 equivalents with reference to the element iron, $P_2O_5$ in an amount that provided 0.15 mass % as the element phosphorus with reference to the element iron, and $SiO_2$ in an amount that provided 0.50 mass % as the element silicon with reference to the element iron. The pH of the aqueous solution was brought to 8.0 and an oxidation reaction was run at 85° C. while blowing in air to prepare a slurry that contained seed crystals.

An aqueous ferrous sulfate solution was then added to this slurry so as to provide 0.90 to 1.20 equivalents with reference to the initial amount of the alkali (sodium component in the sodium hydroxide), after which the oxidation reaction was developed while blowing in air and holding the pH of the slurry at 7.6 to obtain a slurry containing magnetic iron oxide.

After filtration and washing of the obtained slurry, the water-containing slurry was temporarily taken up. At this point, a small amount of the water-containing slurry was collected and the water content was measured.

Then, without drying, the water-containing slurry was introduced into a separate aqueous medium and redispersion was performed with a pin mill while circulating and stirring the slurry and the pH of the redispersion was adjusted to approximately 4.8.

While stirring, an n-hexyltrimethoxysilane coupling agent was added at 1.6 parts per 100 parts of the magnetic iron oxide (the amount of the magnetic iron oxide was calculated as the value provided by subtracting the water content from the water-containing slurry) and hydrolysis was carried out. This was followed by thorough stirring and bringing the pH of the dispersion to 8.6 and the execution of a surface treatment. The produced hydrophobic magnetic body was filtered on a filter press and washed with a large amount of water, followed by drying for 15 minutes at 100° C. and 30 minutes at 90° C. and grinding of the resulting particles to obtain a treated magnetic body having a volume-average particle diameter of 0.21 μm.

External Additive S-1 Production Example 687.9 parts of methanol, 42.0 parts of pure water, and 47.1 parts of 28 mass % aqueous ammonia were introduced into a 3 L glass reactor fitted with a stirrer, dropping funnels, and thermometer and were mixed. The obtained solution was adjusted to 35° C., and the simultaneous addition of 1,100.0 parts (7.23 mol) of tetramethoxysilane and 395.2 parts of 5.4 mass % aqueous ammonia was started while stirring. The tetramethoxysilane was added dropwise over 5 hours, and the aqueous ammonia was added dropwise over 4 hours.

After the completion of the dropwise addition, hydrolysis was carried out by continuing to stir for an additional 0.2 hours, thus yielding an aqueous methanol dispersion of hydrophilic spherical sol-gel silica fine particles. An ester adapter and a condenser were then installed on the glass reactor and the dispersion was heated to 65° C. and the methanol was distilled off. Pure water was subsequently added in the same amount as the distilled out methanol. The dispersion was thoroughly dried at 80° C. under reduced pressure. The obtained fine particles were heated for 10 minutes at 400° C. in a thermostat. The aforementioned procedure was performed 20 times, and the obtained fine particles were subjected to a pulverization treatment using a pulverizer (Hosokawa Micron Corporation).

500 parts of the fine particles was then introduced into 1,000-mL stainless steel autoclave having a polytetrafluoroethylene inner cylinder. The interior of the autoclave was substituted with nitrogen gas and, while rotating the stirring blade attached to the autoclave at 400 rpm, 0.5 parts of hexamethyldisilazane (HMDS) and 0.1 parts of water were converted into a spray with a dual-flow nozzle and were uniformly sprayed on the fine particles. After stirring for 30 minutes, the autoclave was sealed and heating was carried out for 2 hours at 200° C. The pressure was then reduced in the thusly heated system as such and ammonia removal was carried out to obtain external additive S-1, which consisted of silica fine particles. The properties of external additive S-1 are given in Table 2.

External Additives S-2 to S-6 Production Example

External additives S-2 to S-6 were obtained proceeding as in the External Additive S-1 Production Example, but changing the particle diameter of the silica fine particles used and adjusting the intensity of the pulverization treatment as appropriate. The properties are given in Table 2.

External Additive S-7 Production Example

The silica starting material (fumed silica with a number-average primary particle diameter=12 nm) was introduced into a stirrer-equipped autoclave and was heated to 200° C. while being fluidized by stirring.

The interior of the reactor was substituted with nitrogen gas and the reactor was sealed, and 25 parts of hexamethyldisilazane per 100 parts of the silica starting material was sprayed into the interior to carry out a silane compound treatment with the silica in a fluidized state. The reaction was ended after the reaction had been continued for 60 minutes. After the reaction was ended, the autoclave was depressurized and was rinsed with a nitrogen gas current to remove the excess hexamethyldisilazane and by-products from the hydrophobic silica.

While stirring the hydrophobic silica in the reaction chamber, 10 parts of dimethylsilicone oil (viscosity=100 $mm^2$/second) was sprayed in per 100 parts of the silica starting material and stirring was continued for 30 minutes. The temperature was then raised to 300° C. while stirring, and stirring was performed for an additional 2 hours. This was followed by removal and the execution of a pulverization treatment to obtain an external additive S-7 consisting of silica fine particles. The properties are given in Table 2.

External Additive S-8 Production Example

An external additive S-8 was obtained proceeding as in the External Additive S-7 Production Example, but changing the particle diameter of the silica fine particles used and adjusting the intensity of the pulverization treatment as appropriate. The properties of the external additive S-8 are given in Table 2.

External Additive S-9 Production Example

External additive S-9, consisting of organic/inorganic composite fine particles, was produced in accordance with Example 1 in WO 2013/063291. The properties are given in Table 2.

Toner Particle T-1 Production Example

An aqueous medium containing a dispersing agent was obtained by introducing 450 parts of a 0.1 mol/L aqueous $Na_3PO_4$ solution into 720 parts of deionized water; heating to 60° C.; and then adding 67.7 parts of a 1.0 mol/L aqueous $CaCl_2$ solution.

| | |
|---|---|
| Styrene | 75.0 parts |
| n-Butyl acrylate | 25.0 parts |

-continued

| | |
|---|---|
| Amorphous polyester APES1 | 10.0 parts |
| Divinylbenzene | 0.6 parts |
| Iron complex of monoazo dye (T-77, Hodogaya Chemical Co., Ltd.) | 1.5 parts |
| Treated magnetic body | 65.0 parts |

Using an attritor (Mitsui Miike Chemical Engineering Machinery Co., Ltd.), this formulation was dispersed and mixed to uniformity to obtain a monomer composition. This monomer composition was heated to 63° C. and 15.0 parts of paraffin wax (melting point=78° C.) was added and mixed thereinto and was dissolved. This was followed by the dissolution of 6.0 parts of the polymerization initiator tert-butyl peroxypivalate.

This monomer composition was introduced into the aforementioned aqueous medium, and granulation was performed at 60° C. under a nitrogen atmosphere by stirring for 10 minutes at 12,000 rpm with a Model TK Homomixer (Tokushu Kika Kogyo Co., Ltd.).

A reaction was then run for 4 hours at 70° C. while stirring with a paddle stirring blade. After completion of the reaction, it was confirmed here that colored resin particles were dispersed in the resulting aqueous medium and that calcium phosphate was attached as an inorganic dispersing agent to the surfaces of these colored resin particles.

The aqueous medium with the dispersed colored resin particles was heated to 100° C. and held for 120 minutes. This was followed by cooling to room temperature at 3° C. per minute, dissolution of the dispersing agent by the addition of hydrochloric acid, and filtration, washing with water, and drying to obtain a toner particle T-1 having a weight-average particle diameter (D4) of 8.0 μm. The Tg of toner particle T-1 was 54° C.

Toner Particles T-2 to T-6 Production Example

The production of toner particles T-2 to T-6 was carried out proceeding as in the Toner Particle T-1 Production Example, but changing the amorphous polyester and the amount of polymerization initiator addition used in the production of toner particle T-1 to that shown in Table 3. The production conditions for the obtained toner particles are given in Table 3.

Toner Particle T-7 Production Example

The production of toner particle T-7 was carried out proceeding as in the Toner Particle T-1 Production Example, but changing the amorphous polyester and the amount of polymerization initiator addition used in the production of toner particle T-1 to that shown in Table 3 and changing the granulation rpm to 15,000 rpm. The production conditions for the obtained toner particle are given in Table 3.

Toner Particle T-8 Production Example

Production of the Individual Dispersions

Resin Particle Dispersion (1)

Styrene (Wako Pure Chemical Industries, Ltd.): 325 parts n-Butyl acrylate (Wako Pure Chemical Industries, Ltd.): 100 parts Acrylic acid (Rhodia Nicca, Ltd.): 13 parts 1,10-Decanediol diacrylate (Shin-Nakamura Chemical Co., Ltd.): 1.5 parts Dodecanethiol (Wako Pure Chemical Industries, Ltd.): 3 parts These components were preliminarily mixed and dissolved to prepare a solution; a surfactant solution of 9 parts of an anionic surfactant (Dowfax A211, The Dow Chemical Company) dissolved in 580 parts of deionized water was placed in a flask; 400 parts of the aforementioned solution was introduced with dispersion and emulsification; and 6 parts of ammonium persulfate dissolved in 50 parts deionized water was introduced while slowly stirring and mixing for 10 minutes.

Then, after the interior of the flask had been thoroughly substituted with nitrogen, the interior of the flask was heated to 75° C. on an oil bath while stirring the flask, and emulsion polymerization was continued in this state for 5 hours to obtain a resin particle dispersion (1).

The resin particles were separated from the resin particle dispersion (1) and the properties were checked with the following results: number-average particle diameter=195 nm, solids fraction in the dispersion=42%, glass transition temperature=51.5° C., weight-average molecular weight (Mw)=32,000.

Resin Particle Dispersion (2)

The aforementioned amorphous polyester (APES2) was dispersed using as the disperser a Cavitron CD1010 (Eurotec, Ltd.) that had been modified to support high temperatures and high pressures. Specifically, a resin fine particle dispersion (2) having a number-average particle diameter of 200 nm was obtained using a composition ratio of 79 mass % deionized water, 1 mass % (as effective component) anionic surfactant (Neogen RK, DKS Co. Ltd.), and 20 mass % amorphous polyester (APES2), adjusting to a pH of 8.5 using ammonia, and operating the Cavitron under the following conditions: rotor rotation rate=60 Hz, pressure=5 kg/cm$^2$, heating to 140° C. with a heat exchanger.

Colorant Dispersion

Carbon black: 20 parts

Anionic surfactant (Neogen R, DKS Co. Ltd.): 2 parts

Deionized water: 78 parts

Using a homogenizer (Ultra-Turrax T50, IKA) for these components, the pigment was mixed in the water for 2 minutes at 3,000 rpm and was additionally dispersed for 10 minutes at 5,000 rpm. This was followed by defoaming by stirring for 24 hours using an ordinary stirring device. Then, using an Ultimizer high-pressure impact-type disperser (HJP30006, Sugino Machine Limited), dispersion was performed for approximately 1 hour at a pressure of 240 MPa to obtain a colorant dispersion. The pH of this dispersion was adjusted to 6.5.

Release Agent Dispersion

Hydrocarbon wax: 45 parts (Fischer-Tropsch wax, peak temperature of maximum endothermic peak=78° C., weight-average molecular weight=750)

Anionic surfactant (Neogen RK, DKS Co. Ltd.): 5 parts

Deionized water: 200 parts

These components were heated to 95° C. and were thoroughly dispersed using a homogenizer (Ultra-Turrax T50, IKA). This was followed by dispersion processing using a high-pressure ejection-type Gaulin homogenizer to yield a release agent dispersion having a number-average particle diameter of 190 nm and a solids fraction of 25%.

Toner Particle Production Example

Deionized water: 400 parts

Resin particle dispersion (1): 620 parts (resin particle concentration: 42%)

Resin particle dispersion (2): 279 parts (resin particle concentration: 20%)

Anionic surfactant: 1.5 parts (0.9 parts as effective component) (Neogen RK, effective component content: 60%, DKS Co. Ltd.)

These components were introduced into a 3 L reactor equipped with a thermometer, pH meter, and stirrer and, while controlling the temperature with a mantle heater from the exterior, holding was carried out for 30 minutes at a temperature of 30° C. and a stirring rate of 150 rpm.

This was followed by the introduction of 88 parts of the colorant dispersion and 60 parts of the release agent dispersion and holding for 5 minutes. While maintaining this state, the pH was adjusted to 3.0 by adding a 1.0% aqueous nitric acid solution.

The stirrer and mantle heater were then removed. While dispersing at 3,000 rpm using a homogenizer (Ultra-Turrax T50, IKA Japan), one-half of a mixed solution of 0.33 parts of polyaluminum chloride and 37.5 parts of a 0.1% aqueous nitric acid solution was added. The dispersion rotation rate was subsequently brought to 5,000 rpm; the remaining one-half was added over 1 minute; and the dispersion rotation rate was brought to 6,500 rpm and dispersion was carried out for 6 minutes.

The stirrer and mantle heater were mounted on the reactor and, while adjusting the rotation rate of the stirrer as appropriate so as to thoroughly stir the slurry, heating was carried out to 42° C. at 0.5° C./minute. After holding for 15 minutes at 42° C., the particle diameter was measured every 10 minutes using a Coulter Multisizer while raising the temperature at 0.05° C./minute. When the weight-average particle diameter had reached 7.8 μm, the pH was brought to 9.0 using a 5% aqueous sodium hydroxide solution.

Then, while adjusting the pH to 9.0 every 5° C., the temperature was raised to 96° C. at a ramp rate of 1° C./minute and holding was carried out for 3 hours at 96° C. This was followed by cooling to 20° C. at 1° C./minute to induce solidification of the particles.

The reaction product was subsequently filtered and washed by water throughflow with deionized water. When the conductivity of the filtrate reached to 50 mS or less, the particle cake was removed and was introduced into deionized water in an amount that was 10 times the mass of the particles. The particles were thoroughly dispersed by stirring with a Three-One motor, at which point the pH was adjusted to 3.8 with a 1.0% aqueous nitric acid solution and holding was performed for 10 minutes.

This was followed by another filtration and washing by water throughflow. When the conductivity of the filtrate reached 10 mS or less, the water throughflow was stopped and solid-liquid separation was carried out.

The resulting particle cake was pulverized with a sample mill and dried for 24 hours in a 40° C. oven. The resulting powder was pulverized with a sample mill and then additionally vacuum dried for 5 hours in a 40° C. oven to obtain toner particle T-8.

Toner 1 Production Example

Using a Mitsui Henschel mixer (FM) (Mitsui Miike Chemical Engineering Machinery Co., Ltd.), 100 parts of toner particle T-1, 0.3 parts of external additive S-1, and 0.6 parts of external additive S-7 were mixed for 5 minutes at 3,600 rpm. A heat treatment was then performed using the apparatus shown in FIG. 2.

With regard to the structure of the apparatus shown in FIG. 2, an apparatus was used that had a diameter for the inner circumference of the main casing 31 of 130 mm and a volume for the processing space 39 of $2.0\times10^{-3}$ m$^3$. The rated power of the drive member 38 was 5.5 kW, and the stirring members 33 had the shape indicated in FIG. 3. In addition, the overlap width d between a stirring member 33*a* and a stirring member 33*b* in FIG. 3 was 0.25 D with respect to the maximum width D of a stirring member 33, and the clearance between a stirring member 33 and the inner circumference of the main casing 31 was 3.0 mm. Hot water was injected through the jacket so as to bring the temperature within the starting material inlet port inner piece 316 to 55° C.

The aforementioned external addition-treated toner was introduced into the apparatus shown in FIG. 2 with the structure described above, followed by a 5-minute heat treatment while adjusting the peripheral velocity of the outermost tip of the stirring members 33 so as to make the power from the drive member 38 constant at $1.5\times10^{-2}$ W/g (rotation rate of the drive member 38: approximately 150 rpm).

After the completion of the heat treatment, sieving was performed on a mesh with an aperture of 75 μm to yield toner 1. The formulation and properties are given in Table 4.

Toners 2 to 16 Production Example

Toners 2 to 16 were obtained proceeding as in the Toner 1 Production Example, but changing the formulation and production conditions in the Toner 1 Production Example to those given in Table 4. The properties are given in Table 4.

Toner 17 Production Example

Toner 17 was obtained proceeding as in the Toner 1 Production Example, but changing the formulation in the Toner 1 Production Example to that given in Table 4 and changing the heat treatment apparatus to a Mitsui Henschel mixer (FM) (Mitsui Miike Chemical Engineering Machinery Co., Ltd.). Heating and mixing were performed using the following conditions: temperature in the compartment: 50° C., rotation rate: 150 rpm, and rotation time: 5 minutes. The properties are given in Table 4.

Toner 18 Production Example

Toner 18 was obtained proceeding as in the Toner 1 Production Example, but changing the formulation in the Toner 1 Production Example to that given in Table 4 and changing the heat treatment apparatus to a Mitsui Henschel mixer (Mitsui Miike Chemical Engineering Machinery Co., Ltd.). Heating and mixing were performed using the following conditions: temperature in the compartment: 45° C., rotation rate: 150 rpm, and rotation time: 5 minutes. The properties are given in Table 4.

Toner 19 Production Example

Using a Mitsui Henschel mixer (Mitsui Miike Chemical Engineering Machinery Co., Ltd.), 100 parts of toner particle T-3, 0.3 parts of external additive S-1, and 0.6 parts of external additive S-7 were mixed for 5 minutes at 3,600 rpm. This was followed by standing at quiescence for 40 hours in a thermostatted chamber at a temperature of 50° C. and a humidity of 55% RH. Toner 19 was then obtained by sieving on a mesh with an aperture of 75 μm. The properties are given in Table 4.

Toner 20 Production Example

The formulation in the Toner 1 Production Example was changed to that in Table 4 and a 5-minute mixing process was performed with the temperature of the apparatus shown in FIG. 2 set to 22° C. and adjustment of the peripheral velocity of the outermost tip of the stirring members 33 so as to make the power from the drive member 38 constant at $1.7\times10^{-1}$ W/g (rotation rate of the drive member 38: approximately 1,000 rpm). This was followed by sieving on a mesh with an aperture of 75 μm to yield toner 20. The properties are given in Table 4.

Toners 21 to 23 Production Example

Toners 21 to 23 were obtained proceeding as in the Toner 1 Production Example, but without using the apparatus shown in FIG. 2 and changing the formulation and production conditions in the Toner 1 Production Example to those shown in Table 4. The properties are given in Table 4.

Example 1

Toner 1 was filled into the cartridge (CF230X) for an HP printer (LaserJet Pro m203dw) that used a cleanerless system and the following evaluations were performed.

On-Drum Post-Black Fogging

The on-drum post-black fogging was evaluated, using the aforementioned evaluation machine, in a 5° C./30% RH environment under the hypothesis of a very low temperature environment.

The fogging is measured using a Reflectometer Model TC-6DS from Tokyo Denshoku Co., Ltd. A green filter is used for the filter. Mylar tape was applied to the drum (electrostatic latent image bearing member) for a white image immediately after the output of a solid black image, and this Mylar tape was applied to paper and the reflectance was measured thereon. The on-drum post-black fogging was determined by subtracting this reflectance from the Macbeth density of Mylar tape that had been directly applied to paper, and it was evaluated using the evaluation criteria given below.

Fogging(%)=reflectance(%) of the tape directly applied to paper−reflectance(%) of the tape that was applied to the drum With regard to the timing of the evaluation, the on-drum fogging is evaluated when 3,500 prints have been output, which is the nominal print life of the cartridge, and, hypothesizing a more severe use environment, after 5,000 prints have been made, which is approximately 1.5-times the nominal print life. The image for the durability test was horizontal lines providing a print percentage of 1%, and it was output in an intermittent mode in which the machine was temporarily stopped after every two sheet feeds. A C or better was regarded as excellent. The results are given in Table 5.

A: less than 5%
B: 5% or more and less than 10%
C: 10% or more and less than 20%
D: 20% or more Development Ghosts The evaluation of development ghosts was performed as follows. Operating in a low-temperature, low-humidity environment (temperature=15° C./relative humidity=10% RH), a plurality of 10 mm×10 mm solid images was formed on the front half of the transfer paper and a 2 dot×3 space halftone image was formed on the rear half. The degree to which traces of the solid image appeared on the halftone image was visually graded according to the following scale. With regard to the timing of the evaluation, the evaluation was carried out after the feed of 3,500 sheets under the same conditions as in the procedure for evaluating the on-drum post-black fogging. A C or better was regarded as excellent. The results are given in Table 5.

A: Ghosting is not produced.
B: Ghosting is produced to a very minor degree.
C: Ghosting is produced to a minor degree.
D: Ghosting is produced to a substantial degree.

Fading

Fading, in which band-shaped drop out is produced in the image, was evaluated in a high-temperature, high-humidity environment (32.5° C./80% RH).

Grading was carried out by printing out a solid black image and performing a visual evaluation, using the criteria given below, of the difference between the density in a normal image area and the density in a band-shaped light-density region produced on the image. With regard to the timing of the evaluation, the evaluation was carried out after the feed of 5,000 sheets under the same conditions as in the procedure for evaluating the on-drum post-black fogging. A C or better was regarded as excellent. The results are given in Table 5.

A: There is absolutely no area in which a light density occurs.

B: A slight area of light density occurrence is observed.

C: An area of light density occurrence is observed.

D: A significant density difference is observed.

Image Density

The image density was measured as follows: a full-side solid black image was formed in a high-temperature, high-humidity environment (32.5° C./80% RH), and the density of this solid image was measured using a MacBeth densitometer (MacBeth Corporation) and an SPI filter. With regard to the timing of the evaluation, the evaluation was carried out on the first print and after the feed of 3,500 sheets and 5,000 sheets under the same conditions as in the procedure for evaluating the on-drum post-black fogging. The results are given in Table 5.

Developing Sleeve Coating Defects

The coating performance at the developing sleeve was evaluated after the feed, in a low-temperature, low-humidity environment (temperature=15° C./relative humidity=10% RH), of 5,000 sheets under the same conditions as in the procedure for evaluating the on-drum post-black fogging.

For the evaluation, the status of the toner coating of the surface of the developing sleeve was observed, and the presence/absence of coating defects (control defects) originating with toner overcharging was visually scored according to the following criteria. A C or better was regarded as excellent. The results are given in Table 5.

A: Coating defects on the developing sleeve are not observed.

B: Coating defects are present on the developing sleeve to a slight degree, but do not appear in the image.

C: Coating defects are clearly present on the developing sleeve, but do not appear in the image.

D: Coating defects are present on the developing sleeve and image defects originating with the coating defects are exhibited.

Examples 2 to 18 and Comparative Examples 1 to 4

The same evaluations as in Example 1 were performed on the toners given in Table 5. The results are given in Table 5.

TABLE 1

| Amorphous Polyesters | | | | |
|---|---|---|---|---|
| Amorphous polyester | | | APES1 | APES2 |
| Starting monomer | Alcohol component | 2 mol adduct of PO on bisphenol A | 100 | 100 |
| | | 2 mol adduct of EO on bisphenol A | — | — |
| | Carboxylic acid component | Terephthalic acid | 67 | 90 |
| | | Trimellitic anhydride | 3 | 10 |
| | | Fumaric acid (C4) | — | — |
| | | Adipic acid (C6) | 20 | — |
| | | Stearic acid (molecular chain terminal component) | 10 | — |
| | Carboxylic acid component/alcohol component | | 0.88 | 0.90 |
| | Peak molecular weight of the amorphous polyester | | 10000 | 10500 |
| | Softening point (° C.) | | 95 | 125 |
| | Acid value (mgKOH/g) | | 6.0 | 8.0 |
| | Hydroxyl value (mgKOH/g) | | 20.0 | 51.0 |

In the table, the numerical values for the starting monomer are in mol parts; the value of carboxylic acid component/alcohol component is the molar ratio; and PO represents propylene oxide and EO represents ethylene oxide.

TABLE 2

| | Number-average particle diameter of the primary particles (nm) | True density (g/cm$^3$) |
|---|---|---|
| S-1 | 100 | 2.2 |
| S-2 | 180 | 2.2 |
| S-3 | 200 | 2.2 |
| S-4 | 250 | 2.2 |
| S-5 | 60 | 2.2 |
| S-6 | 40 | 2.2 |
| S-7 | 12 | 2.2 |
| S-8 | 20 | 2.2 |
| S-9 | 80 | 1.6 |

TABLE 3

| | | Poly-merization initiator | Colorant | | |
|---|---|---|---|---|---|
| Toner particle No. | APES type | Amount of addition [parts] | Type | Amount of addition [parts] | Tg (° C.) |
| T-1 | APES1 | 6.0 | Treated magnetic body | 65 | 54 |
| T-2 | APES1 | 4.0 | Treated magnetic body | 65 | 55 |
| T-3 | APES2 | 5.0 | Treated magnetic body | 65 | 55 |
| T-4 | APES2 | 3.5 | Treated magnetic body | 65 | 56 |
| T-5 | APES2 | 2.5 | Treated magnetic body | 65 | 57 |
| T-6 | APES2 | 10.0 | Treated magnetic body | 65 | 52 |
| T-7 | APES1 | 4.0 | Treated magnetic body | 65 | 53 |
| T-8 | Described in Specification | | | | 55 |

TABLE 4

| | Toner No. | | | | | |
|---|---|---|---|---|---|---|
| | 1 | 2 | 3 | 4 | 5 | 6 |
| Toner particle No. | T-1 | T-2 | T-1 | T-1 | T-1 | T-1 |
| Silica fine particle A | S-1 | S-1 | S-1 | S-1 | S-1 | S-1 |
| parts | 0.30 | 0.30 | 0.30 | 0.30 | 0.30 | 0.30 |

TABLE 4-continued

| | | | | | | |
|---|---|---|---|---|---|---|
| Silica fine particle B | S-7 | S-7 | S-7 | S-7 | S-7 | S-7 |
| parts | 0.60 | 0.60 | 0.60 | 0.50 | 0.70 | 0.70 |
| Apparatus | FM | FM | FM | FM | FM | FM |
| Rotation rate (rpm) | 3600 | 3600 | 3600 | 3600 | 3600 | 3600 |
| Rotation time (min) | 5 | 5 | 5 | 5 | 5 | 5 |
| Apparatus | FIG. 2 | FIG. 2 | FIG. 2 | FIG. 2 | FIG. 2 | FIG. 2 |
| Temperature ° C. | 55 | 55 | 50 | 45 | 60 | 60 |
| Power (w/g) | $1.5 \times 10^{-2}$ | $1.5 \times 10^{-2}$ | $1.5 \times 10^{-2}$ | $1.5 \times 10^{-2}$ | $1.5 \times 10^{-2}$ | $1.5 \times 10^{-2}$ |
| Time (min) | 5 | 5 | 5 | 5 | 5 | 8 |
| Toner D4 (μm) | 8.0 | 8.0 | 8.0 | 8.0 | 8.0 | 8.0 |
| Mp (T) | 22000 | 28000 | 22000 | 22000 | 22000 | 22000 |
| AC | 0.970 | 0.970 | 0.970 | 0.970 | 0.970 | 0.970 |
| S (%) | 89.3 | 80.2 | 85.6 | 81.3 | 95.2 | 99.3 |
| Load A (mN) | 1.30 | 1.34 | 1.25 | 1.21 | 1.45 | 1.48 |
| X1 (area %) | 50.3 | 49.2 | 48.3 | 45.2 | 60.2 | 62.3 |
| X1/X2 | 0.627 | 0.615 | 0.602 | 0.670 | 0.651 | 0.672 |
| DL | 0.410 | 0.414 | 0.418 | 0.431 | 0.368 | 0.360 |
| TE (mJ) | 290 | 280 | 310 | 340 | 250 | 230 |
| MT (volume %) | 58.3 | 58.2 | 57.3 | 55.6 | 59.1 | 60.3 |

| | Toner No. | | | | | |
|---|---|---|---|---|---|---|
| | 7 | 8 | 9 | 10 | 11 | 12 |
| Toner particle No. | T-1 | T-3 | T-3 | T-3 | T-8 | T-7 |
| Silica fine particle A | S-9 | S-1 | S-1 | S-1 | S-5 | S-2 |
| parts | 2.00 | 0.30 | 0.30 | 0.30 | 0.30 | 0.30 |
| Silica fine particle B | | S-7 | S-7 | S-7 | S-7 | S-7 |
| parts | | 0.80 | 0.90 | 0.90 | 0.50 | 0.60 |
| Apparatus | FM | FM | FM | FM | FM | FM |
| Rotation rate (rpm) | 3600 | 3600 | 3600 | 3600 | 3600 | 3600 |
| Rotation time (min) | 5 | 5 | 5 | 5 | 5 | 5 |
| Apparatus | FIG. 2 | FIG. 2 | FIG. 2 | FIG. 2 | FIG. 2 | FIG. 2 |
| Temperature ° C. | 55 | 50 | 55 | 40 | 55 | 55 |
| Power (w/g) | $1.5 \times 10^{-2}$ | $1.5 \times 10^{-1}$ | $1.5 \times 10^{-1}$ | $1.5 \times 10^{-2}$ | $1.5 \times 10^{-2}$ | $1.5 \times 10^{-2}$ |
| Time (min) | 5 | 5 | 5 | 5 | 5 | 5 |
| Toner D4 (μm) | 8.0 | 8.0 | 8.0 | 8.0 | 8.0 | 8.0 |
| Mp (T) | 22000 | 22000 | 22000 | 22000 | 24000 | 28000 |
| AC | 0.970 | 0.965 | 0.965 | 0.965 | 0.96 | 0.98 |
| S (%) | 91.5 | 88.1 | 95.3 | 81.6 | 83.6 | 90.2 |
| Load A (mN) | 1.35 | 1.22 | 1.27 | 1.15 | 1.17 | 1.43 |
| X1 (area %) | 53.0 | 65.1 | 70.3 | 70.3 | 44.6 | 49.3 |
| X1/X2 | 0.967 | 0.621 | 0.597 | 0.597 | 0.777 | 0.631 |
| DL | 0.410 | 0.347 | 0.326 | 0.326 | 0.452 | 0.414 |
| TE (mJ) | 275 | 240 | 210 | 200 | 350 | 300 |
| MT (volume %) | 58.0 | 59.3 | 60.5 | 59.4 | 56.3 | 57.1 |

| | Toner No. | | | | | |
|---|---|---|---|---|---|---|
| | 13 | 14 | 15 | 16 | 17 | 18 |
| Toner particle No. | T-6 | T-6 | T-4 | T-4 | T-3 | T-3 |
| Silica fine particle A | S-6 | S-8 | S-3 | S-4 | S-1 | S-1 |
| parts | 0.20 | 0.20 | 1.00 | 1.00 | 0.30 | 0.30 |
| Silica fine particle B | S-7 | S-7 | S-7 | S-7 | S-7 | S-7 |
| parts | 0.20 | 0.20 | 1.70 | 2.00 | 0.60 | 0.60 |
| Apparatus | FM | FM | FM | FM | FM | FM |
| Rotation rate (rpm) | 3600 | 3600 | 3600 | 3600 | 3600 | 3600 |
| Rotation time (min) | 5 | 5 | 5 | 5 | 5 | 5 |
| Apparatus | FIG. 2 | FIG. 2 | FIG. 2 | FIG. 2 | FM | FM |
| Temperature ° C. | 40 | 60 | 55 | 50 | 50 | 45 |
| Power (w/g) | $1.5 \times 10^{-1}$ | $5.0 \times 10^{-1}$ | $7.5 \times 10^{-3}$ | $1.5 \times 10^{-3}$ | $1.5 \times 10^{-2}$ | $1.5 \times 10^{-2}$ |
| Time (min) | 15 | 10 | 5 | 5 | 5 | 5 |
| Toner D4 (μm) | 8.0 | 8.0 | 8.0 | 8.0 | 8.0 | 8.0 |
| Mp (T) | 13000 | 13000 | 30000 | 30000 | 22000 | 22000 |
| AC | 0.971 | 0.971 | 0.968 | 0.968 | 0.965 | 0.965 |
| S (%) | 90.6 | 99.1 | 78.3 | 75.3 | 79 | 75.3 |
| Load A (mN) | 1.17 | 1.15 | 1.25 | 1.49 | 1.17 | 1.15 |
| X1 (area %) | 43.2 | 40.5 | 80.3 | 82.6 | 36.3 | 30.5 |
| X1/X2 | 1.320 | 0.998 | 0.363 | 0.320 | 0.452 | 0.376 |
| DL | 0.439 | 0.452 | 0.284 | 0.276 | 0.469 | 0.494 |
| TE (mJ) | 370 | 380 | 200 | 180 | 400 | 450 |
| MT (volume %) | 55.3 | 62.6 | 60.3 | 60.5 | 40.1 | 38.2 |

| | Toner No. | | | | |
|---|---|---|---|---|---|
| | 19 | 20 | 21 | 22 | 23 |
| Toner particle No. | T-3 | T-3 | T-6 | T-3 | T-5 |
| Silica fine particle A | S-1 | S-1 | S-7 | S-7 | S-8 |

TABLE 4-continued

| | | | | | |
|---|---|---|---|---|---|
| parts | 0.30 | 0.30 | 0.50 | 2.00 | 0.40 |
| Silica fine particle B | S-7 | S-7 | | | |
| parts | 0.60 | 0.60 | | | |
| Apparatus | FM | FM | FM | FM | FM |
| Rotation rate (rpm) | 3600 | 3600 | 4200 | 3000 | 3600 |
| Rotation time (min) | 5 | 5 | 10 | 2 | 5 |
| Apparatus | H | FIG. 2 | — | — | — |
| Temperature ° C. | | 22 | | | |
| Power (w/g) | | $1.7 \times 10^{-1}$ | | | |
| Time (min) | | 5 | | | |
| Toner D4 (μm) | 8.0 | 8.0 | 8.0 | 8.0 | 8.0 |
| Mp (T) | 22000 | 22000 | 13000 | 22000 | 35000 |
| AC | 0.965 | 0.965 | 0.97 | 0.965 | 0.97 |
| S (%) | 79.1 | 73.2 | 95.3 | 70.3 | 73.6 |
| Load A (mN) | 1.15 | 0.98 | 1.14 | 1.30 | 1.60 |
| X1 (area %) | 40.3 | 49.3 | 40.2 | 82.6 | 30.6 |
| X1/X2 | 0.317 | 0.615 | 0.638 | 0.327 | 0.998 |
| DL | 0.490 | 0.414 | 0.452 | 0.276 | 0.494 |
| TE (mJ) | 420 | 270 | 360 | 170 | 420 |
| MT (volume %) | 65.3 | 58.3 | 55.3 | 56.2 | 59.1 |

In the Table 4, AC is "average circularity", S (%) is "fixing ratio of Silica", DL is "diffusion index lower limit (0.0042×X1+0.62)", MT is "methanol wettability", and H indicates "Holding in thermostat".

TABLE 5

| | | Example No. | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| Toner No. | | 1 | 2 | 3 | 4 | 5 | 6 | 7 | 8 | 9 | 10 | 11 | 12 |
| On-drum post-black fogging | 3500 prints | A | A | A | A | A | A | A | A | A | C | B | A |
| | | 3.5 | 3.8 | 3.7 | 3.6 | 3.9 | 4.3 | 3.7 | 4.3 | 4.7 | 10.2 | 8.3 | 4.3 |
| | 5000 prints | A | A | A | B | A | A | A | B | A | C | B | A |
| | | 4.1 | 4.2 | 4.3 | 8.3 | 4.2 | 4.8 | 4.3 | 6.1 | 4.3 | 11.5 | 9.4 | 4.8 |
| Development ghosts | | A | A | A | A | A | A | A | A | A | A | A | A |
| Fading | | A | A | A | A | A | A | A | A | A | C | A | A |
| Image density | First print | 1.46 | 1.47 | 1.48 | 1.46 | 1.47 | 1.48 | 1.48 | 1.47 | 1.46 | 1.48 | 1.46 | 1.47 |
| | 3500 prints | 1.41 | 1.42 | 1.41 | 1.43 | 1.41 | 1.40 | 1.40 | 1.41 | 1.42 | 1.43 | 1.41 | 1.42 |
| | 5000 prints | 1.34 | 1.33 | 1.32 | 1.31 | 1.30 | 1.32 | 1.33 | 1.31 | 1.31 | 1.30 | 1.34 | 1.32 |
| Coating performance | | A | A | A | A | A | A | A | A | A | A | A | A |

| | | Example No. | | | | | | | | | | |
|---|---|---|---|---|---|---|---|---|---|---|---|---|
| | | 13 | 14 | 15 | 16 | 17 | 18 | 19 | CE 1 | CE 2 | CE 3 | CE 4 |
| Toner No. | | 13 | 14 | 15 | 16 | 17 | 18 | 19 | 19 | 20 | 21 | 22 |
| On-drum post-black fogging | 3500 prints | B | B | A | B | B | C | C | D | C | C | C |
| | | 7.8 | 8.2 | 4.3 | 8.6 | 8.7 | 10.3 | 16.5 | 20.2 | 19.6 | 17.3 | 18.9 |
| | 5000 prints | B | C | B | C | B | C | C | D | D | D | D |
| | | 9.6 | 10.5 | 7.1 | 10.3 | 9.5 | 12.5 | 17.8 | 21.5 | 22.5 | 20.5 | 22.6 |
| Development ghosts | | A | B | B | C | C | C | B | A | B | C | C |
| Fading | | A | A | B | C | B | C | C | A | A | C | C |
| Image density | First print | 1.48 | 1.46 | 1.48 | 1.41 | 1.38 | 1.38 | 1.37 | 1.46 | 1.45 | 1.40 | 1.45 |
| | 3500 prints | 1.38 | 1.32 | 1.36 | 1.30 | 1.41 | 1.40 | 1.42 | 1.41 | 1.32 | 1.31 | 1.33 |
| | 5000 prints | 1.26 | 1.19 | 1.29 | 1.26 | 1.35 | 1.31 | 1.32 | 1.31 | 1.26 | 1.24 | 1.23 |
| Coating performance | | A | B | B | A | B | C | C | A | A | A | A |

In Table 5, CE indicates "Comparative Example".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-151621, filed Aug. 4, 2017, which is hereby incorporated by reference herein in its entirety.

What is claimed is:

1. A toner, comprising:

a toner particle containing a binder resin and a colorant; and an external additive, a fixing ratio of the external additive on the toner particle being from 75 to 100%, wherein the average circularity of the toner is at least 0.960, and a load A that provides a maximum value in a load region from 0.20 to 2.30 mN is from 1.15 to 1.50 mN in a differential curve obtained by the differentiation, by load, of a load-displacement curve where the horizontal axis is load (mN) and the vertical axis is displacement (μm), the load-displacement curve being provided by measurement of the strength of the toner by a nanoindentation procedure.

2. The toner according to claim 1, wherein a coverage ratio X1 of the surface of the toner particle by the external additive is from 40.0 to 80.0 area % as measured with an x-ray photoelectron spectrometer.

3. The toner according to claim 2, wherein a diffusion index indicated by the formula Diffusion index=X1/X2 satisfies the formula $$\text{Diffusion index} \geq -0.0042 \times X1 + 0.62$$

where X2 is a theoretical coverage ratio of the surface of the toner particle by the external additive.

4. The toner according to claim 1, wherein the Total Energy is from 200 to 400 mJ when the surface of a powder layer of the toner produced in a measurement vessel by application of a vertical load of 0.88 kPa is penetrated by a propeller-type blade while rotating the propeller-type blade at a peripheral velocity of 10 mm/second at the outermost edge thereof using a powder flowability measuring apparatus.

5. The toner according to claim 1, wherein the external additive contains an external additive having a number-average particle diameter of from 40 to 200 nm.

6. The toner according to claim 1, wherein the methanol concentration at a transmittance of 40% is from 40 to 62 volume % when the wettability of the toner relative to a methanol/water mixed solvent is measured using the transmittance of light having a wavelength of 780 nm.

7. The toner according to claim 1, wherein the external additive contains at least one selected member from the group consisting of silica fine particles and organic/inorganic composite fine particles.

8. The toner according to claim 1, wherein the fixing ratio of the external additive on the toner particle is from 80 to 100%.

9. The toner according to claim 1, wherein the fixing ratio of the external additive on the toner particle is from 80.2 to 100%.

* * * * *